US008317307B2

(12) United States Patent
Ishizawa

(10) Patent No.: US 8,317,307 B2
(45) Date of Patent: Nov. 27, 2012

(54) LIQUID CONTAINER HAVING A STRUCTURE THAT ENABLES RAPID CHARGING

(75) Inventor: Taku Ishizawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 387 days.

(21) Appl. No.: 12/409,334

(22) Filed: Mar. 23, 2009

(65) Prior Publication Data

US 2009/0237475 A1 Sep. 24, 2009

(30) Foreign Application Priority Data

Mar. 24, 2008 (JP) ..... 2008-075998
Feb. 9, 2009 (JP) ..... 2009-027261

(51) Int. Cl.
*B41J 2/175* (2006.01)
*B41J 2/195* (2006.01)

(52) U.S. Cl. ..... 347/86; 347/7

(58) Field of Classification Search ..... 347/86, 347/87

See application file for complete search history.

(56) References Cited

U.S. PATENT DOCUMENTS

| | | | | |
|---|---|---|---|---|
| 4,589,000 | A * | 5/1986 | Koto et al. | 347/87 |
| 5,886,721 | A * | 3/1999 | Fujii et al. | 347/87 |
| 7,097,293 | B2 * | 8/2006 | Ichihashi et al. | 347/86 |
| 7,513,613 | B2 | 4/2009 | Ishizawa et al. | |
| 7,775,650 | B2 | 8/2010 | Ishizawa et al. | |
| 7,954,933 | B2 * | 6/2011 | Fung et al. | 347/86 |
| 2003/0020790 | A1 * | 1/2003 | Kotaki et al. | 347/86 |
| 2005/0099473 | A1 * | 5/2005 | Katayama | 347/86 |
| 2006/0227190 | A1 * | 10/2006 | Ishizawa et al. | 347/86 |
| 2008/0012914 | A1 * | 1/2008 | Ishizawa et al. | 347/86 |
| 2008/0094429 | A1 * | 4/2008 | Miyazawa et al. | 347/7 |
| 2009/0322832 | A1 * | 12/2009 | Wanibe et al. | 347/85 |
| 2009/0322838 | A1 * | 12/2009 | Wanibe et al. | 347/86 |
| 2009/0322839 | A1 * | 12/2009 | Ishizawa et al. | 347/86 |
| 2010/0073438 | A1 * | 3/2010 | Wanibe et al. | 347/85 |

FOREIGN PATENT DOCUMENTS

| | | | |
|---|---|---|---|
| EP | 542247 | A2 * | 5/1993 |
| EP | 0 765 757 | A2 | 4/1997 |
| EP | 0 765 757 | A3 | 7/1998 |
| EP | 1 772 271 | A2 | 4/2007 |
| EP | 1 772 271 | A3 | 5/2007 |
| JP | 2006-306035 | A | 11/2006 |
| JP | 2008-044194 | A | 2/2008 |

* cited by examiner

*Primary Examiner* — Shelby Fidler

(57) ABSTRACT

A rectangular-shaped liquid container has first and second liquid storage chambers, each having an upper face, a bottom face, an upstream opening, and a downstream opening, in fluid communication; a first partition wall defining the bottom face of the first chamber and sloping so as to be lower towards a lowermost part of the first chamber; and a second partition wall defining the upper face of the first chamber and the bottom face of the second chamber and sloping so as to be lower towards a lowermost part of the second chamber. The lowermost parts of the two chambers are adjacent, the upstream and downstream openings of the first chamber are adjacent to the bottom face of the first chamber at its lowermost part, and the upstream and downstream openings of the second chamber are adjacent to the bottom face of the second chamber at its lowermost part.

10 Claims, 22 Drawing Sheets

LIQUID CONTAINER HAVING A STRUCTURE THAT ENABLES RAPID CHARGING

CROSS REFERENCE TO RELATED APPLICATIONS

This application relates to and claims priority from Japanese Patent Application No. 2008-075998, filed on Mar. 24, 2008 and Japanese Patent Application No. 2009-27261, filed on Feb. 9, 2009, the entire disclosure of which is incorporated by reference.

BACKGROUND

1. Technical Field

The present invention relates to a liquid container adapted to contain a liquid that is to be supplied to a liquid consuming apparatus; and to a method of manufacturing the same.

2. Description of the Related Art

An ink cartridge adapted to contain ink, and an inkjet recording device in which such an ink cartridge may be detachably installed, are one example of a liquid container and a liquid consuming apparatus.

An exemplary conventional liquid container is the known liquid container illustrated in FIG. 10 of Patent Citation 1, which is designed to be detachably installed on a liquid consuming apparatus and which within a receptacle body (10) that is placed in service by being installed on the liquid consuming apparatus includes a liquid storage chamber (370, 390) for storing the liquid; a liquid feed hole (50) for feeding the liquid held in the liquid storage chamber to the liquid consuming apparatus; and an air vent hole (100) for drawing air from the outside into the liquid storage chamber in association with consumption of the liquid inside the liquid storage chamber; and in which the liquid storage chamber is divided into two chambers, specifically, a first liquid storage chamber (370) situated at the upstream end and a second liquid storage chamber (390) situated at the downstream end with respect to the direction of flow of the liquid towards the liquid feed hole (50) during service.

According to this prior art example, because the liquid storage chamber is divided into two chambers, air bubbles will not readily infiltrate through the liquid feed hole even if the liquid container is subjected to shock due to being dropped, for example. However, in this prior art example, outlets and inlets for air and liquid to the first and second liquid storage chambers (370, 390) are situated in a dispersed manner. In particular, the outlet and inlet of the flow channel connecting the first and second liquid storage chambers (370, 390) (the outlet from the first liquid storage chamber 370 is indicated by symbol 371) are situated straddling the second liquid storage chamber 390 in the vertical direction so as to be separated from one another by a distance equivalent to the entire height of the second liquid storage chamber (i.e. half the height of the receptacle body).

For this reason, in this prior art example, during filling of the first and second liquid storage chambers (370, 390) with liquid, since flow channel resistance to liquid flowing from the second liquid storage chamber (390) towards the first liquid storage chamber (370) will be greater in association with greater distance separating the outlet and inlet of the flow channel connecting the first and second liquid storage chambers (370, 390) (the second upstream opening and the first downstream opening), as a result it was difficult to fill them with liquid quickly. Also, since the base faces of the first and second liquid storage chambers (370, 390) are sloped only slightly, liquid tended to remain there.

While this drawback may be overcome by making the incline of the base face steeper, with the container oriented in the attitude for charging, i.e. an attitude with the liquid feed hole (50) facing upward, the second upstream opening will be situated at a location below that part of the second liquid storage chamber (390) that is oriented uppermost in this attitude. This creates the problem that the second liquid storage chamber (390) cannot be filled with liquid when the second liquid storage chamber (390) is being charged with liquid via the liquid feed hole (50).

Patent Citation 2 discloses a method for charging a liquid into a liquid container that has two ink storage chambers. However, a drawback of the liquid container disclosed in Patent Citation 2 is that since the base faces of the liquid storage chambers are horizontal, liquid tends to remain inside.

Patent Citation 1: JP Unexamined Patent Publication 2008-044194

Patent Citation 2: JP Unexamined Patent Publication 2006-306035

SUMMARY

The present invention in a first mode provides a liquid container adapted for detachable installation on a liquid consuming apparatus and placed in service by being installed on the liquid consuming apparatus, the liquid container comprising: a liquid storage chamber for storing a liquid; a liquid feed hole for feeding liquid held in the liquid storage chamber to the liquid consuming apparatus; and an air vent hole for drawing air from the outside into the liquid storage chamber in association with consumption of the liquid inside the liquid storage chamber; wherein the liquid storage chamber is divided into at least two chambers including a first liquid storage chamber situated on the upstream side and a second liquid storage chamber situated on the downstream side in relation to the direction of flow of liquid towards the liquid feed hole during service; and dividing and base walls that define the first and second liquid storage chambers are constituted by partition walls that as a whole extend radially towards the liquid storage chamber interior from a radial center part which is situated in proximity to the bottom part of the liquid storage chamber during service, with at least the base walls of the first and second liquid storage chambers being sloped, and with a first upstream opening and a first downstream opening that are situated in the first liquid storage chamber, and a second upstream opening and a second downstream opening that are situated in the second liquid storage chamber, being positioned centered towards the radial center part.

According to this liquid container, because the liquid storage chamber has been divided into at least two chambers including a first liquid storage chamber situated on the upstream side and a second liquid storage chamber situated on the downstream side in relation to the direction of flow of liquid towards the liquid feed hole during service, air bubbles will not readily infiltrate through the liquid feed hole even if the liquid container is subjected to shock due to being dropped, for example.

Additionally, because the dividing walls and the base wall that define the first and second liquid storage chambers are constituted by partition walls that as a whole extend radially towards the liquid storage chamber interior from a radial center part which is situated in proximity to the bottom part of the liquid storage chamber during service; at least the base walls of the first and second liquid storage chambers are formed at an incline; and a first upstream opening and a first downstream opening that are situated in the first liquid storage chamber, and a second upstream opening and a second downstream opening that are situated in the second liquid storage chamber, are positioned centered towards the radial center part, liquid drainage will be improved and liquid intended for consumption will not easily remain in the liquid storage chamber during service with the liquid container installed in a liquid consuming apparatus. Furthermore, because the first upstream opening and the first downstream opening that are situated in the first liquid storage chamber, and the second upstream opening and the second downstream opening that are situated in the second liquid storage chamber, are positioned centered towards the radial center part, it will be possible for the first downstream opening and the second upstream opening of the flow channel that connects the first liquid storage chamber and the second liquid storage chamber to be disposed closer together. Thus, even where the liquid level inside the liquid container fluctuates with consumption of the liquid by the liquid consuming apparatus, fluctuations in liquid pressure at the liquid feed hole can be limited. Also, flow channel resistance to liquid flowing from the second liquid storage chamber towards the first liquid storage chamber can be reduced when the first and second liquid storage chambers are charged with liquid, making rapid charging possible.

From the above it will be appreciated that according to the liquid container herein, charging of liquid can take place rapidly during charging; infiltration by air bubbles through the liquid feed hole may be largely prevented even where the receptacle is subjected to shock after charging; and liquid intended for consumption may be largely prevented from remaining in the liquid storage chamber when installed for service on a liquid consuming apparatus.

Additionally, the liquid container herein affords working effects such as the following. Where the liquid is a water-based liquid (e.g. a water-based ink), if the water-based liquid freezes it will expand in volume. Since the second liquid storage chamber is initially completely filled with liquid, if liquid in an amount equivalent to expansion with freezing does not escape to the first liquid storage chamber, there is a risk that the liquid container will rupture and the liquid will leak out. On the other hand, according to the liquid container herein, because the openings connecting the first and second liquid storage chambers are positioned centered towards the radial center part, as a result, the flow channel connecting the first liquid storage chamber with the second liquid storage chamber can be shorter, and liquid in an amount equivalent to expansion with freezing can reliably escape to the first liquid storage chamber, preventing the receptacle from rupturing.

In another possible arrangement in the first mode, the liquid container further includes a connecting passage that connects the first liquid storage chamber and the second liquid storage chamber; the first downstream opening is the upstream terminus of the connecting passage; the second upstream opening is the downstream terminus of the connecting passage; and the first downstream opening and the second upstream opening are disposed closest towards the center at the radial center part.

With this arrangement, the openings at the termini of the flow channel interconnecting the first and second liquid storage chambers can be positioned closest together, affording further reduction in flow channel resistance to liquid flowing from the second liquid storage chamber towards the first liquid storage chamber during charging with the liquid. Moreover, when frozen, liquid in an amount equivalent to expansion with freezing can more reliably escape to the first liquid storage chamber so that the receptacle can be prevented from rupturing.

In yet another possible arrangement in the first mode, an air chamber for trapping liquid that attempts to backflow from the first liquid storage chamber towards the air vent hole is disposed between the first liquid storage chamber and the air vent hole. With this arrangement, by situating the first upstream opening to the bottom side of the first liquid storage chamber, the downstream opening of the air chamber can be situated on the bottom side of the air chamber. Thus, even if liquid has backflowed into the air chamber, the liquid which has backflowed into the air chamber during consumption of the liquid by the liquid consuming apparatus can be recovered in the first liquid storage chamber, thus reducing the amount of wasted liquid that cannot be used.

In yet another possible arrangement in the first mode, at least a portion of the partition wall that defines the top face of the air chamber is a partition wall identical to the partition wall defining the first or second liquid storage chamber. By so doing, wasted space inside the liquid container can be minimized, and the liquid container can be made more compact.

In yet another possible arrangement in the first mode, the liquid container includes a pressure differential valve disposed between the second downstream opening and the liquid feed hole and adapted to regulate pressure of the liquid;

a bypass flow channel for bypassing the pressure differential valve during charging of liquid to the liquid storage chamber; and obstructing means for obstructing the bypass flow channel subsequent to charging with liquid.

With this arrangement, the pressure of the liquid can be regulated by the pressure differential valve. However, since the pressure differential valve also functions as a check valve, absent any additional measures it will not be possible to charge liquid from the feed hole during charging. With this liquid container, however, because a bypass flow channel for bypassing the pressure differential valve during charging of liquid to the liquid storage chamber has been provided, the liquid can be charged through this bypass flow channel. The bypass flow channel will be obstructed upon completion of charging.

Additionally, with this liquid container, during charging, liquid that has flowed out directly into the second liquid storage chamber from at least part of the bypass flow channel will be charged to the first liquid storage chamber through the second upstream opening and the first downstream opening, thereby allowing the liquid to be charged more rapidly.

The method for manufacturing the liquid container according to another mode of the present invention resides in a method for manufacturing the liquid container according to any of Claims 1 to 5 comprising the steps of:

orienting the liquid container in an attitude so that the bottom part thereof faces upward;

filling the second liquid storage chamber with liquid via the liquid feed hole; and charging the first liquid storage chamber with liquid from the second liquid storage chamber via the second upstream opening and the first downstream opening.

According to this method of manufacturing a liquid container, as noted flow channel resistance to liquid flowing from the second liquid storage chamber towards the first liquid storage chamber can be reduced during charging of liquid to the first and second liquid storage chambers, making rapid charging possible.

An attitude in which the bottom part of the liquid storage chamber faces upward refers to an attitude upside down relative to the attitude when installed in the liquid consuming apparatus. In this attitude, the second upstream opening will be positioned at the uppermost part of the second liquid storage chamber. Thus, when charging liquid to the second liquid storage chamber from the second downstream opening, the second liquid storage chamber can be filled up with the liquid. A compact liquid container devoid of wasted space can be obtained thereby. Moreover, air bubbles will not infiltrate into the liquid feed hole, even when subjected shock due to being dropped, for example.

Moreover, because the second liquid storage chamber progressively narrows in the horizontal direction going towards the lower side in the direction of gravity in the installed attitude, in an attitude upside down relative to the installed attitude, the second liquid storage chamber now progressively narrows in the horizontal direction going towards the upper side in the direction of gravity. Consequently, when the second liquid storage chamber is filled with liquid, any air bubbles remaining in the second liquid storage chamber can be easily expelled through the second upstream opening. The second liquid storage chamber can therefore be filled with liquid without any residual air bubbles.

Also, in this attitude, the first upstream opening will be positioned at the uppermost part of the first liquid storage chamber. Thus, when charging liquid to the first liquid storage chamber from the first downstream opening, liquid will not readily infiltrate into the first upstream opening even if the liquid should rise due to charging. Thus, leakage of liquid from the air vent hole due to liquid infiltrating into the air chamber can be prevented. Additionally, because the first liquid storage chamber progressively narrows in the horizontal direction going towards the lower side in the direction of gravity in the installed attitude, in an attitude upside down relative to the installed attitude, the first liquid storage chamber now progressively narrows in the horizontal direction going towards the upper side in the direction of gravity. Thus, when charging of liquid is halted with the liquid level some distance away from the first upstream opening in order to prevent liquid from infiltrating into the air chamber during charging, the volume of this unfilled section of the first liquid storage chamber can be minimized. A compact liquid container devoid of wasted space can be obtained thereby.

A second mode of the present invention provides a liquid container attachable to a liquid consuming apparatus. The liquid container pertaining to the second mode has substantially rectangular parallelepiped shape having a bottom face that is situated at bottom when the liquid container is attached to the liquid consuming apparatus, and a first side face that is substantially orthogonal to the bottom face. The liquid container pertaining the second mode comprises a liquid storage portion that stores a liquid, a liquid feed portion that is situated downstream from the liquid storage portion and that feeds the liquid to the liquid consuming apparatus, and an air introduction portion that is situated upstream from the liquid storage portion and that introduces air into the liquid storage portion from an upstream side in association with feed of the liquid to the liquid consuming apparatus. The liquid storage portion includes a first liquid storage chamber having a first storage chamber bottom face situated at bottom, a first upstream opening situated along the first storage chamber bottom face, and a first downstream opening situated along the first storage chamber bottom face, a second liquid storage chamber that is situated further downstream from the first liquid storage chamber and that includes a second storage chamber bottom face situated at bottom, a second upstream opening situated along the second storage chamber bottom face, and a first downstream opening situated along the second storage chamber bottom face, and a connecting flow channel disposed between the first downstream opening and the second upstream opening so as to connect the first liquid storage chamber with the second liquid storage chamber. The first upstream opening, the first downstream opening, the second upstream opening, and the second downstream opening are juxtaposed in proximity to the bottom face of the liquid container. The first storage chamber bottom face slopes so as to be lower towards the juxtaposed first upstream opening and first downstream opening with the container attached to the liquid consuming apparatus. The second storage chamber bottom face slopes so as to be lower towards the juxtaposed second upstream opening and second downstream opening with the container attached to the liquid consuming apparatus.

The liquid container of the present mode affords working effects comparable to those of the first mode described previously, namely, of limiting infiltration of air bubbles into the liquid feed portion, achieving rapid charging of liquid, reducing the amount of liquid intended for consumption which remains in the liquid storage chamber, and preventing rupture of the liquid container due to freezing of the liquid.

In another possible arrangement in the present mode, the first downstream opening and the second upstream opening may be closer together than the second downstream opening and the first upstream opening are. By so doing, the connecting flow channel can be shorter, and rupture of the liquid container can be reliably prevented.

In yet another possible arrangement in the present mode, the first downstream opening, the second upstream opening, and the connecting flow channel may be formed along the first side face of the liquid container. By so doing, the connecting flow channel can be even shorter and rupture of the liquid container can be reliably prevented.

In yet another possible arrangement in the present mode, there may be provided an air chamber disposed between the first liquid storage chamber and the air introduction portion, and adapted to trap liquid that attempts to backflow from the first liquid storage chamber towards the air introduction portion. By so doing, the air chamber can be situated to the lower side of first storage chamber bottom face. Thus, even if liquid has backflowed into the air chamber, the liquid which has backflowed into the air chamber during consumption of the liquid by the liquid consuming apparatus can be recovered in the first liquid storage chamber, thus reducing the amount of wasted liquid that cannot be used.

In yet another possible arrangement in the present mode, at least part of a wall that defines the first storage chamber bottom face may be a partition wall substantially orthogonal to the first side face of the liquid container. The air chamber may have an upper a wall that defines an air chamber upper face that is situated on an upper side when the liquid container attached to the liquid consuming apparatus. At least part of the upper wall also may provide the partition wall. By so doing, wasted space inside the liquid container can be minimized, and the liquid container can be made more compact.

A third mode of the present invention provides a method of manufacturing liquid container attachable to a liquid consuming apparatus. The manufacturing method includes the steps of: (a) providing an unfilled liquid container of the second mode; (b) orienting the unfilled liquid container with the bottom face facing upward; (c) while maintaining the aforementioned attitude, filling the second liquid storage chamber with the liquid via the liquid feed portion; and (d) while maintaining the aforementioned attitude, charging the liquid from the second liquid storage chamber into the first liquid storage chamber via the connecting flow channel. By so doing, the liquid can be charged rapidly to the first liquid storage chamber and the second liquid storage chamber, to manufacture the liquid container.

In another possible arrangement for the manufacturing method of the present mode, the unfilled liquid container includes a pressure differential valve disposed between the second downstream opening and the liquid feed portion and adapted to regulate pressure of the liquid, and a bypass flow channel for shunting the liquid so as to bypass the pressure differential valve while charging of liquid from the liquid feed portion to the second liquid storage chamber in the step (c). The manufacturing method further comprises the step (e) obstructing the bypass flow channel upon completion of charging with the liquid. By so doing, where a pressure differential valve has been disposed between the liquid feed portion and the second liquid storage chamber, liquid can be charged from the liquid feed portion to the second liquid storage chamber via the bypass flow channel.

The above and other objects, characterizing features, aspects and advantages of the invention will be clear from the description of preferred embodiments presented below along with the attached drawings.

DETAILED DESCRIPTION OF THE PREFERRED EMBODIMENTS

The preferred embodiments of the present invention will now be described in detail. The embodiments set forth hereinbelow are not intended to unduly limit the particulars of the present invention recited in the appended claims; nor should all of the arrangements described in the embodiments be construed as essential means for solving the problems addressed by the present invention.

Figure 1:
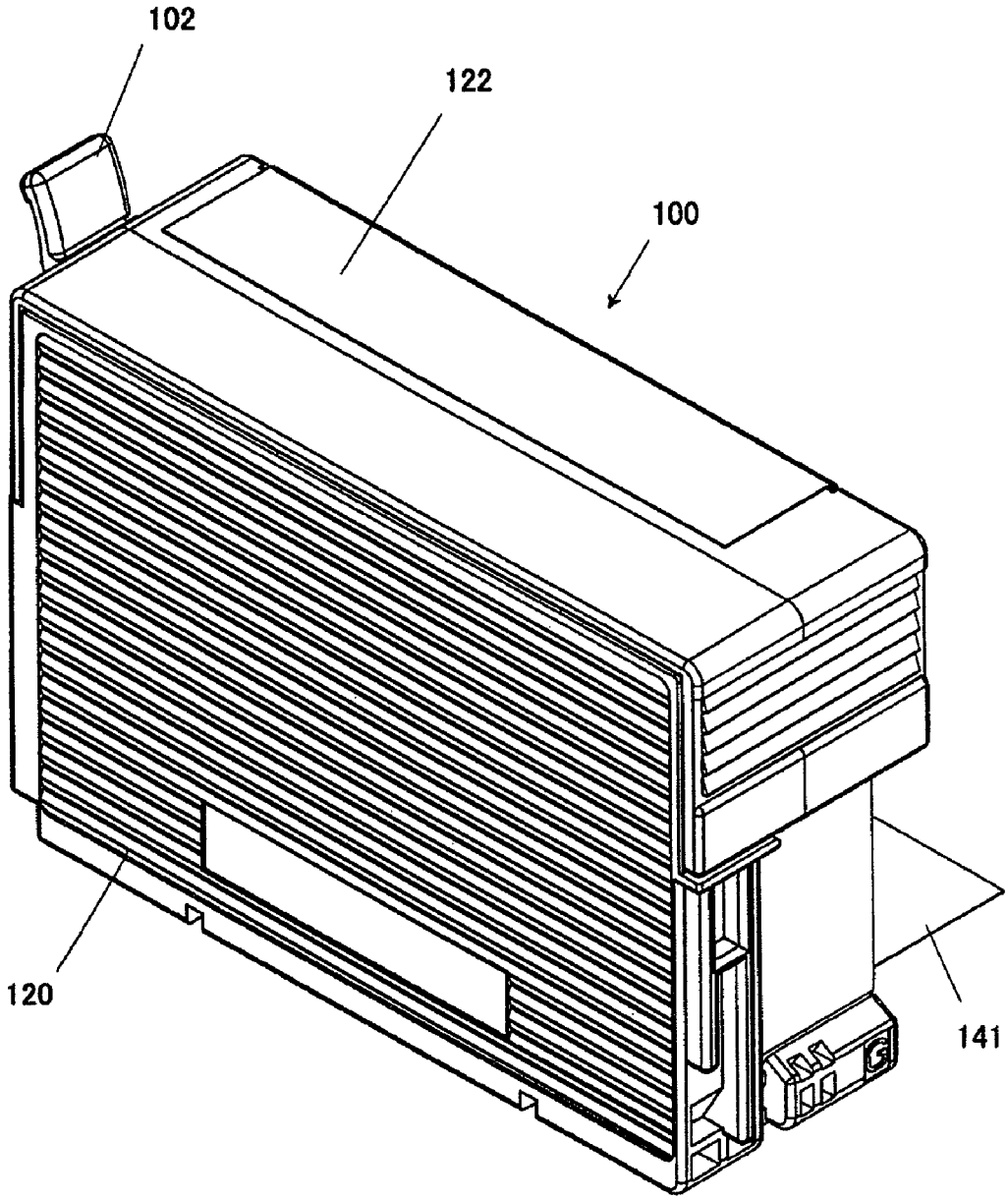
FIG. 1 is an exterior perspective view of an ink cartridge as an embodiment of liquid container according to the present invention, viewed from the front side.
Figure 2:
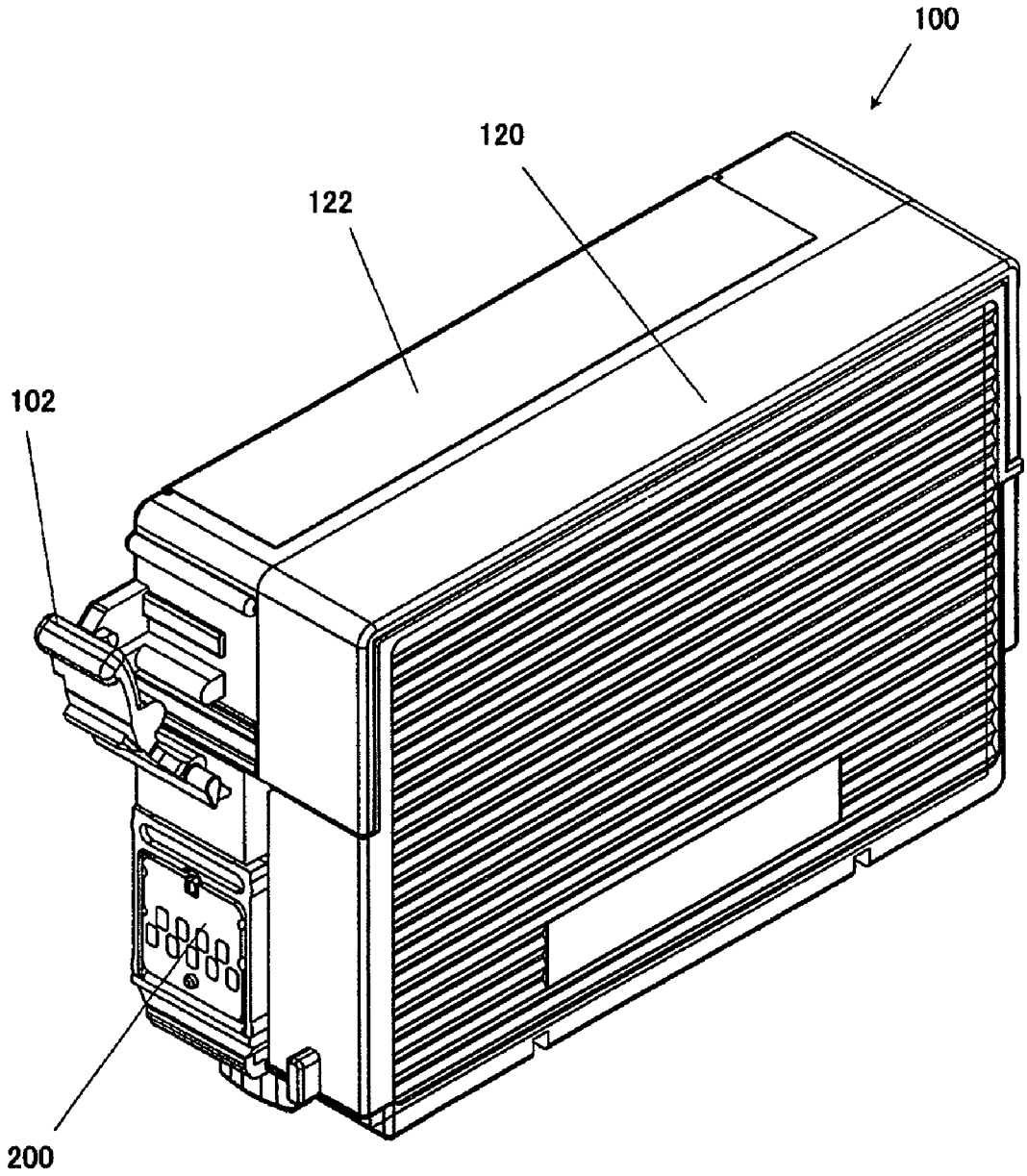
FIG. 2 is an exterior perspective view thereof viewed from the front side.
Figure 3:
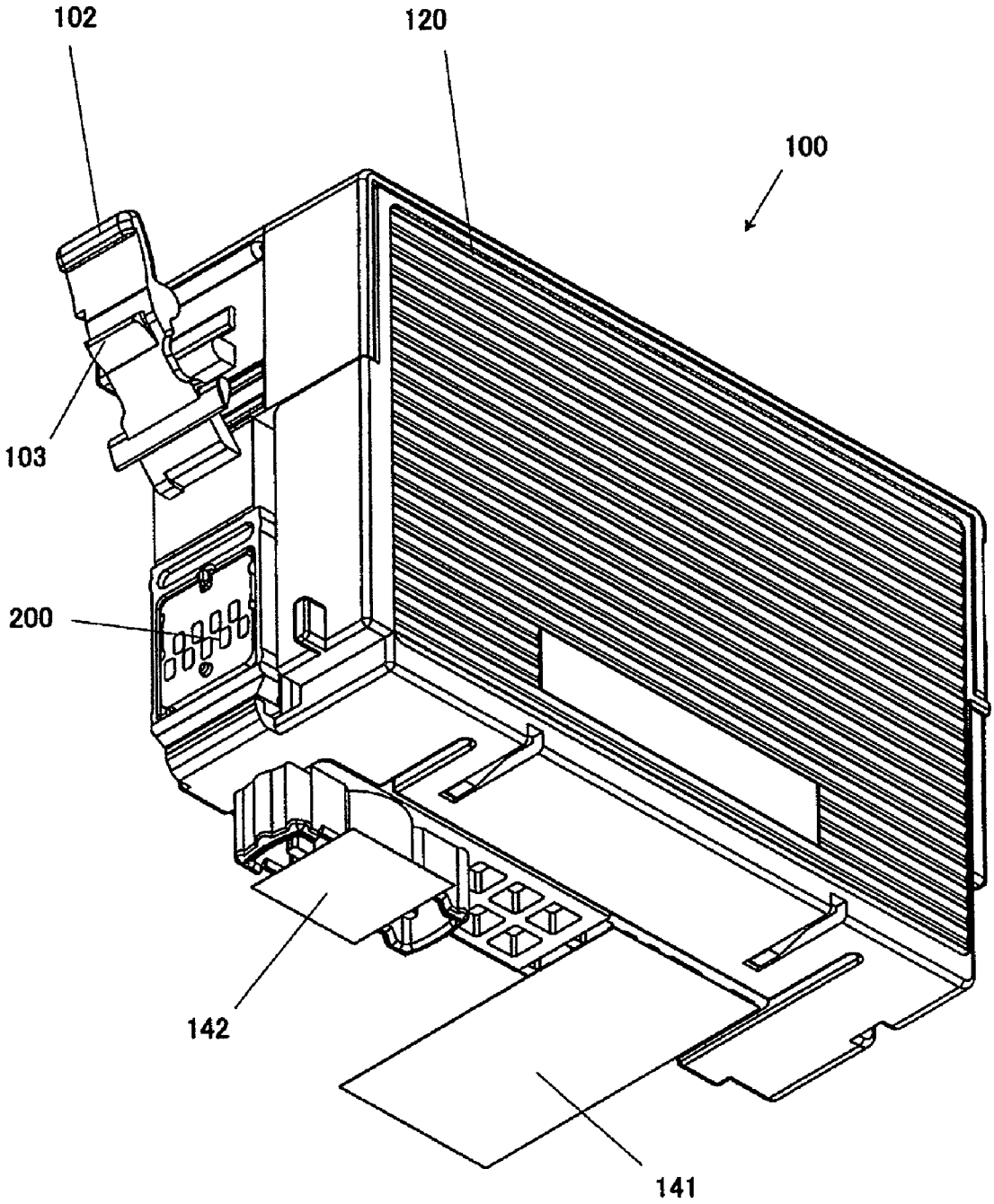
FIG. 3 is an exterior perspective view thereof viewed from the front side.
Figure 4:
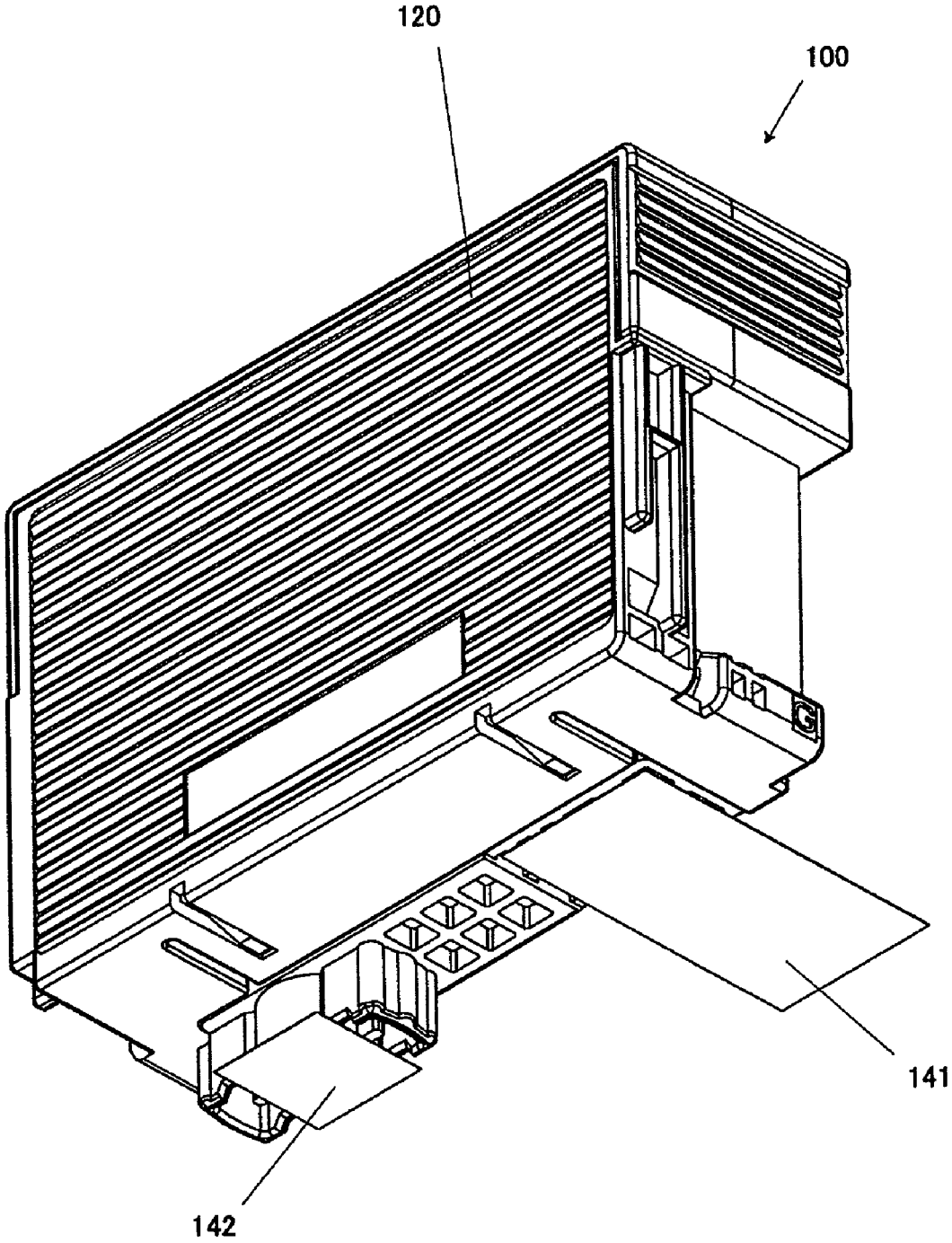
FIG. 4 is an exterior perspective view thereof viewed from the front side.
Figure 5:
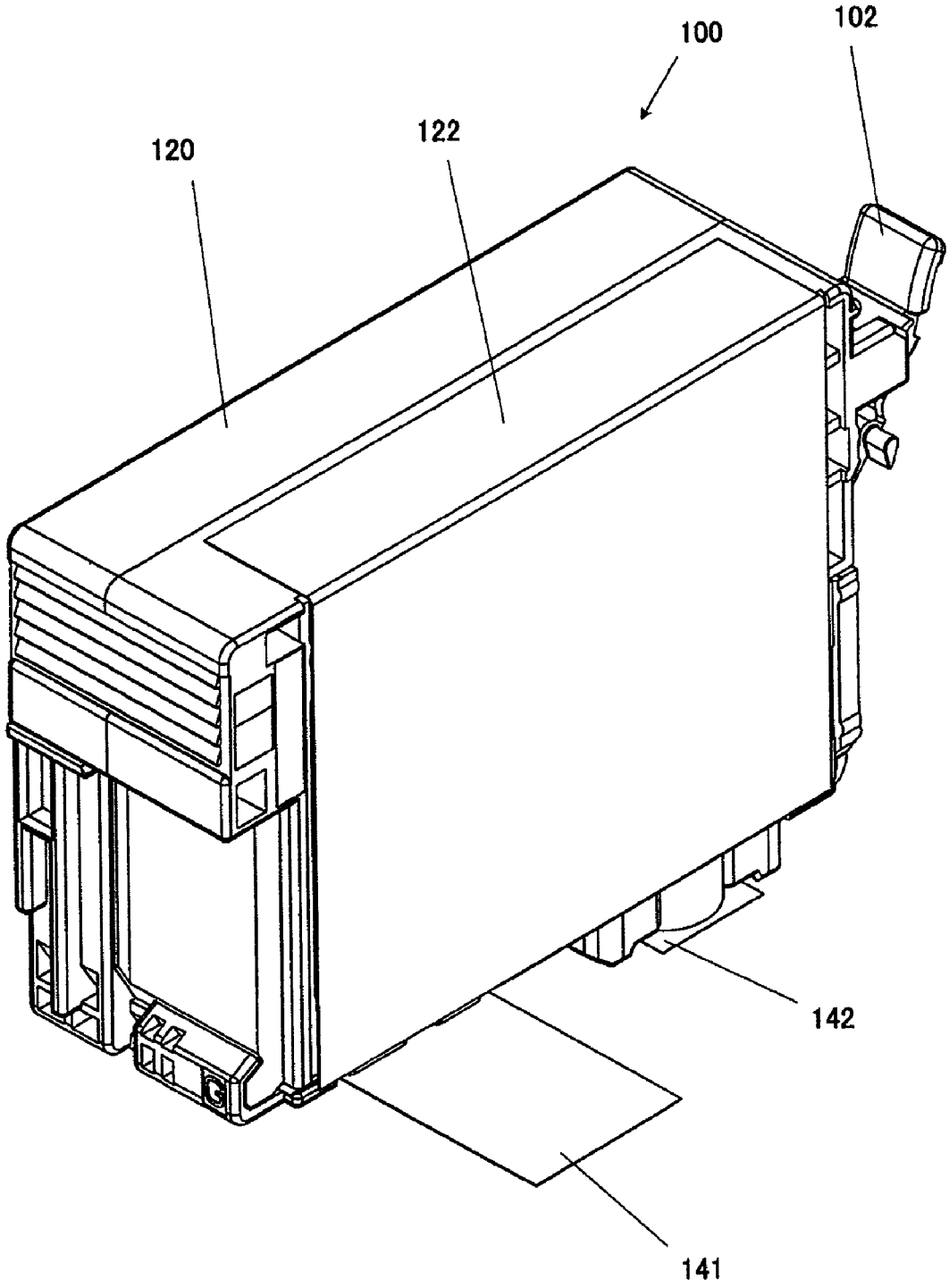
FIG. 5 is an exterior perspective view thereof viewed from the rear side.
Figure 6:
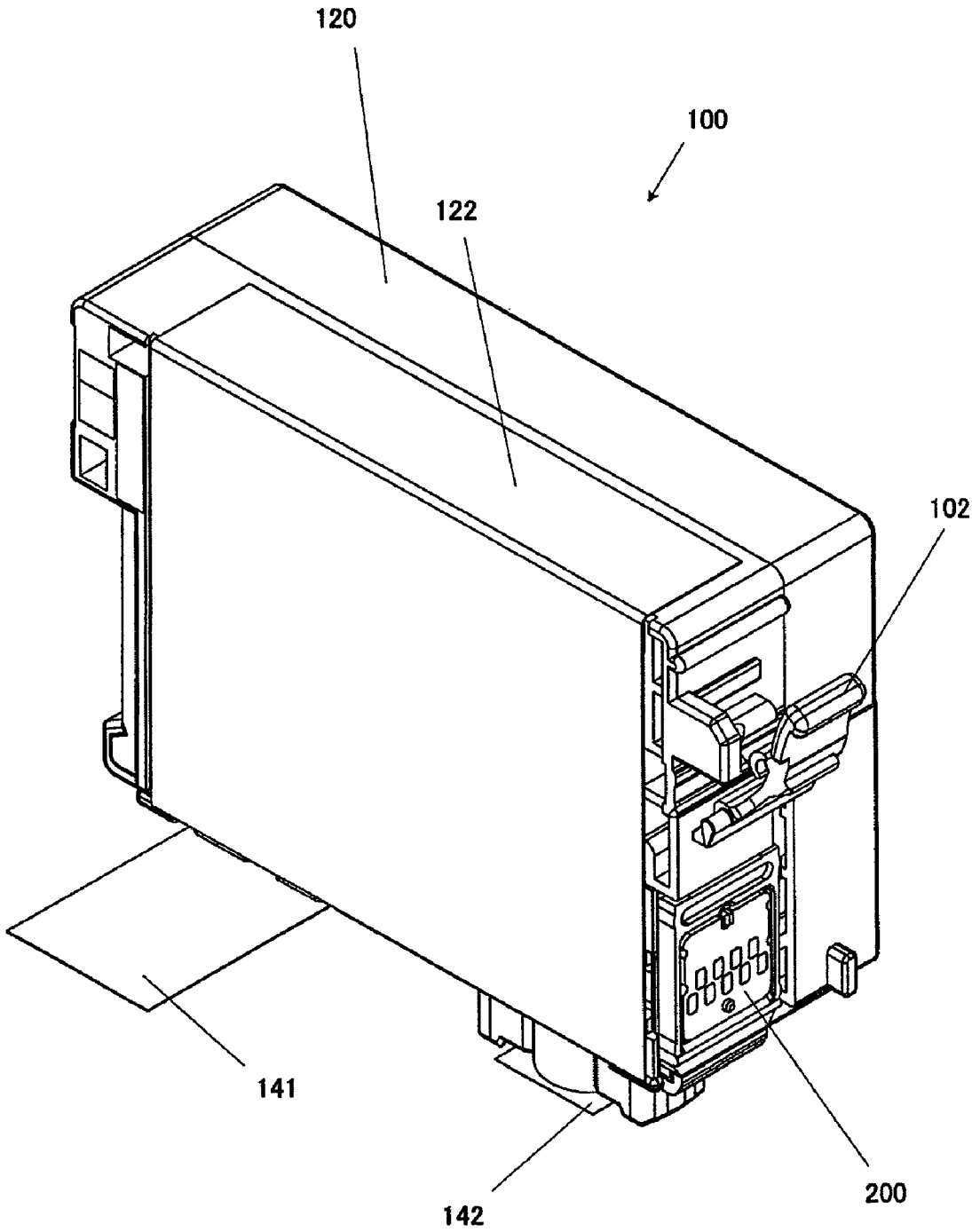
FIG. 6 is an exterior perspective view thereof viewed from the rear side.
Figure 7:
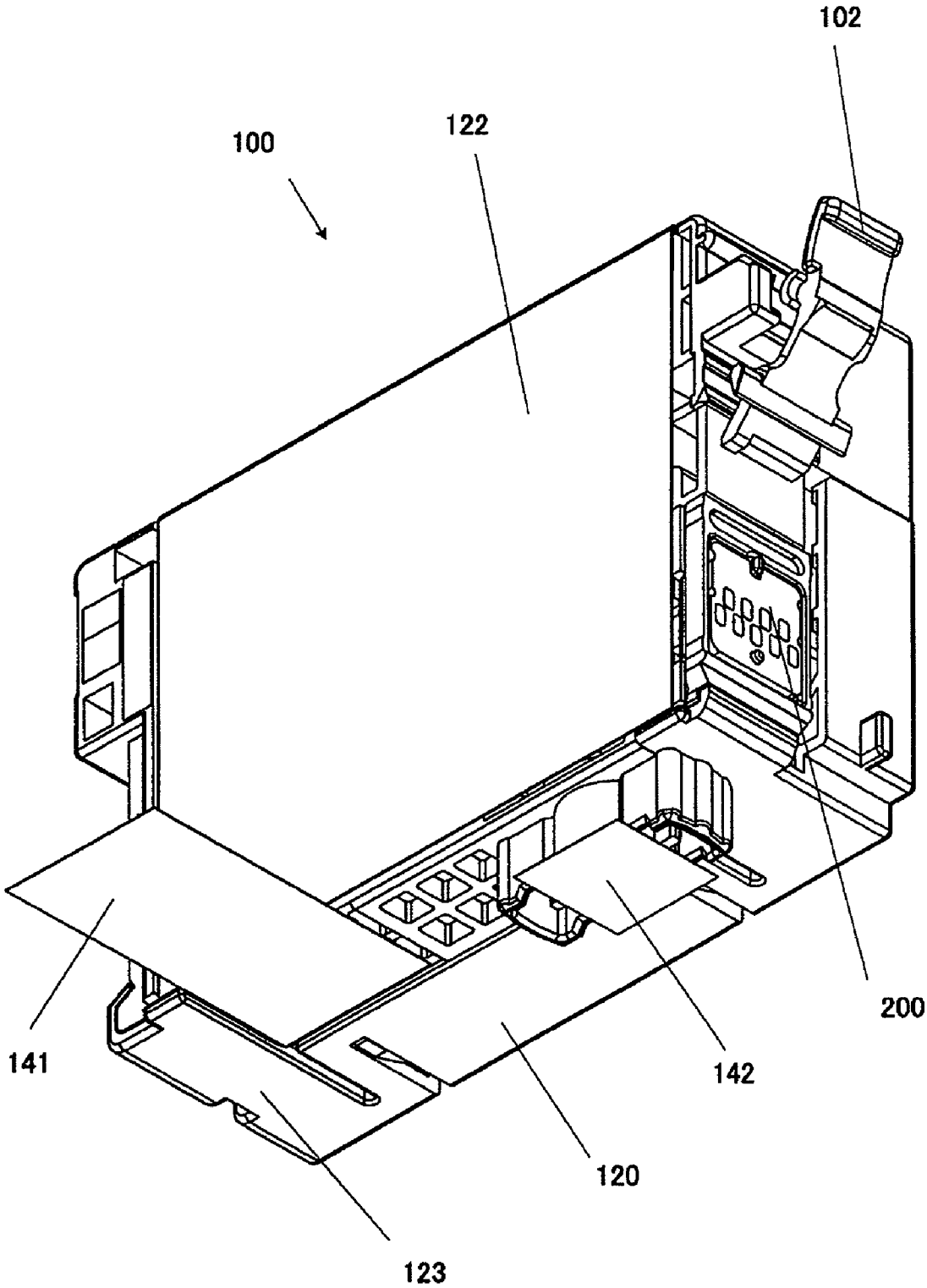
FIG. 7 is an exterior perspective view thereof viewed from the rear side.
Figure 8:
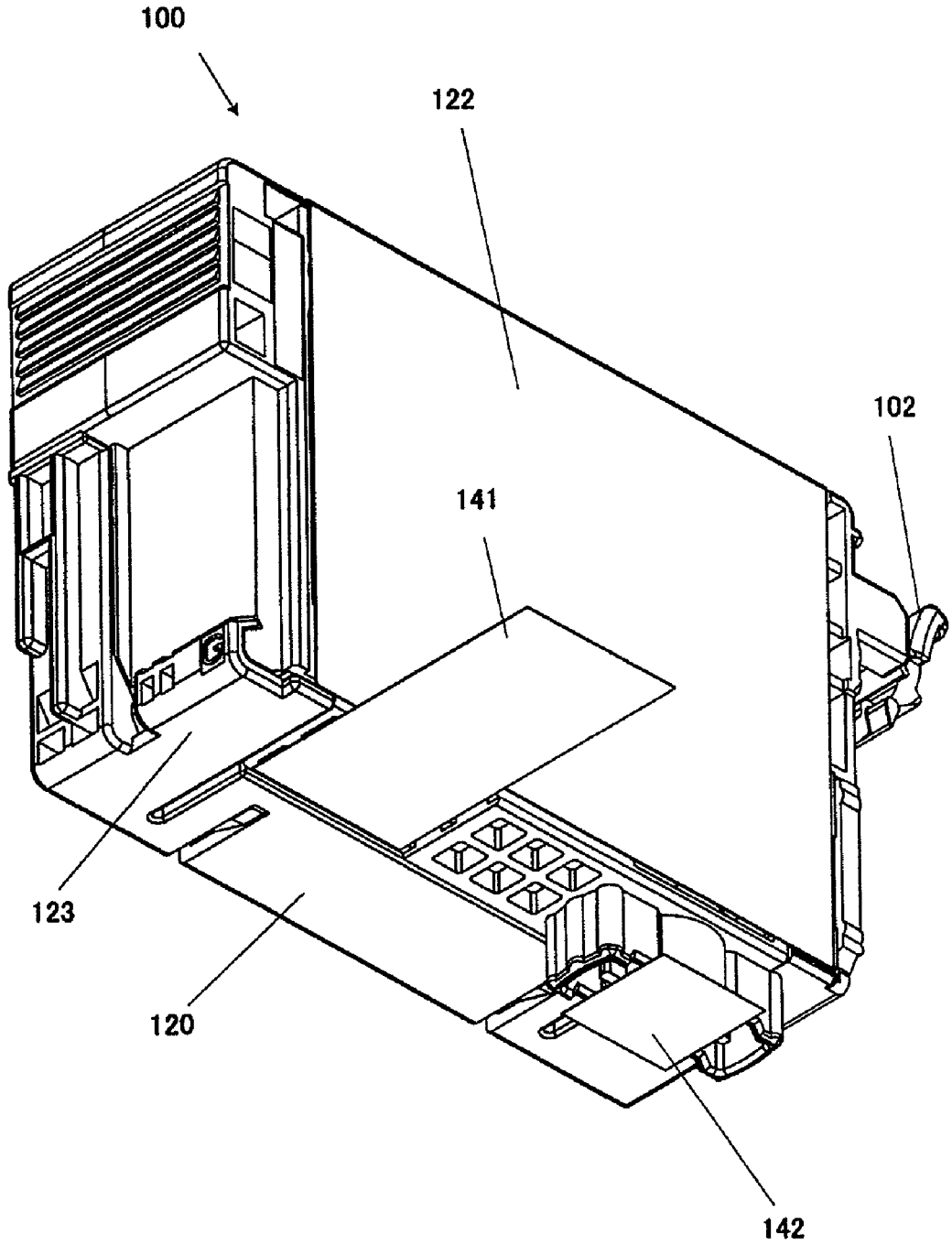
FIG. 8 is an exterior perspective view thereof viewed from the rear side.
Figure 9:
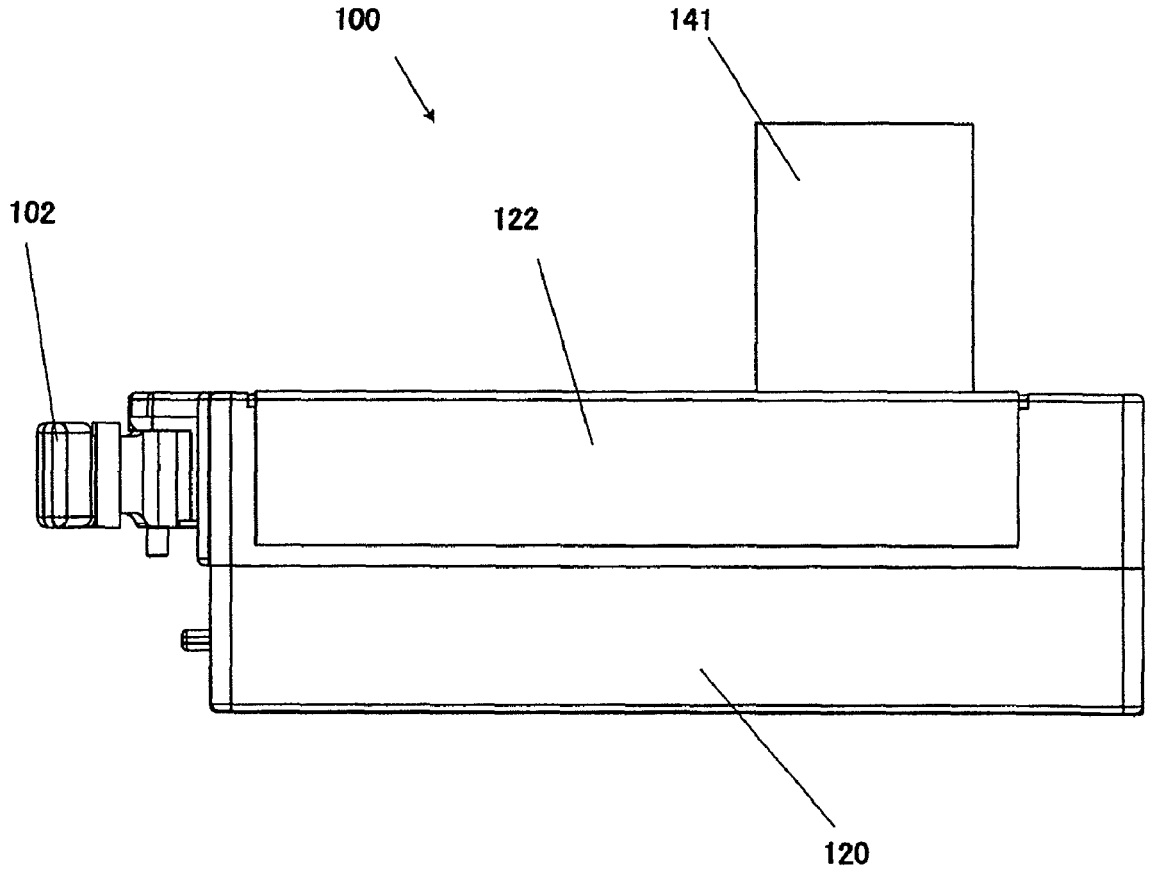
FIG. 9 is a plan view of the ink cartridge of the embodiment.
Figure 10:
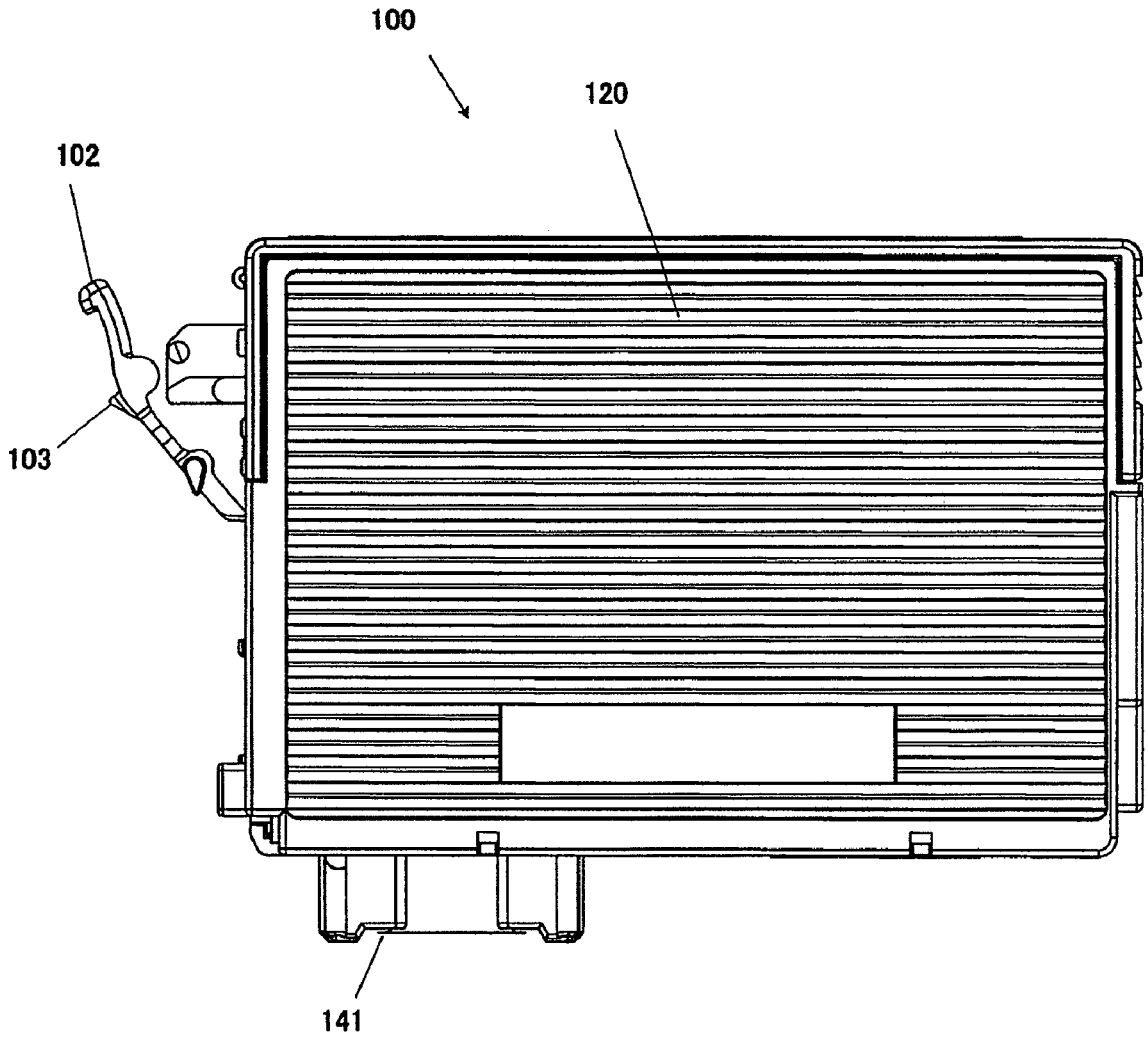
FIG. 10 is a front view thereof.
Figure 11:
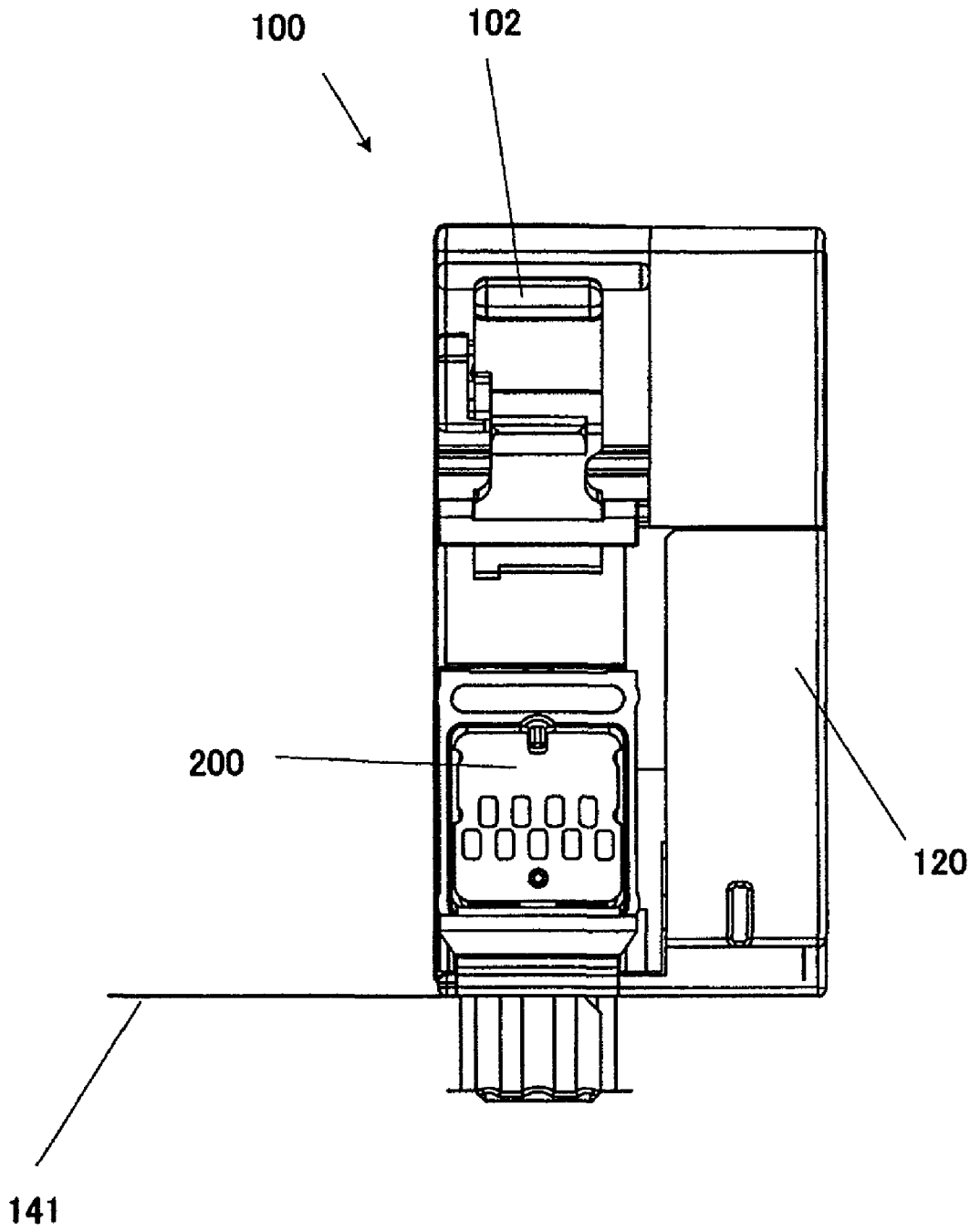
FIG. 11 is a left side view thereof.
Figure 12:
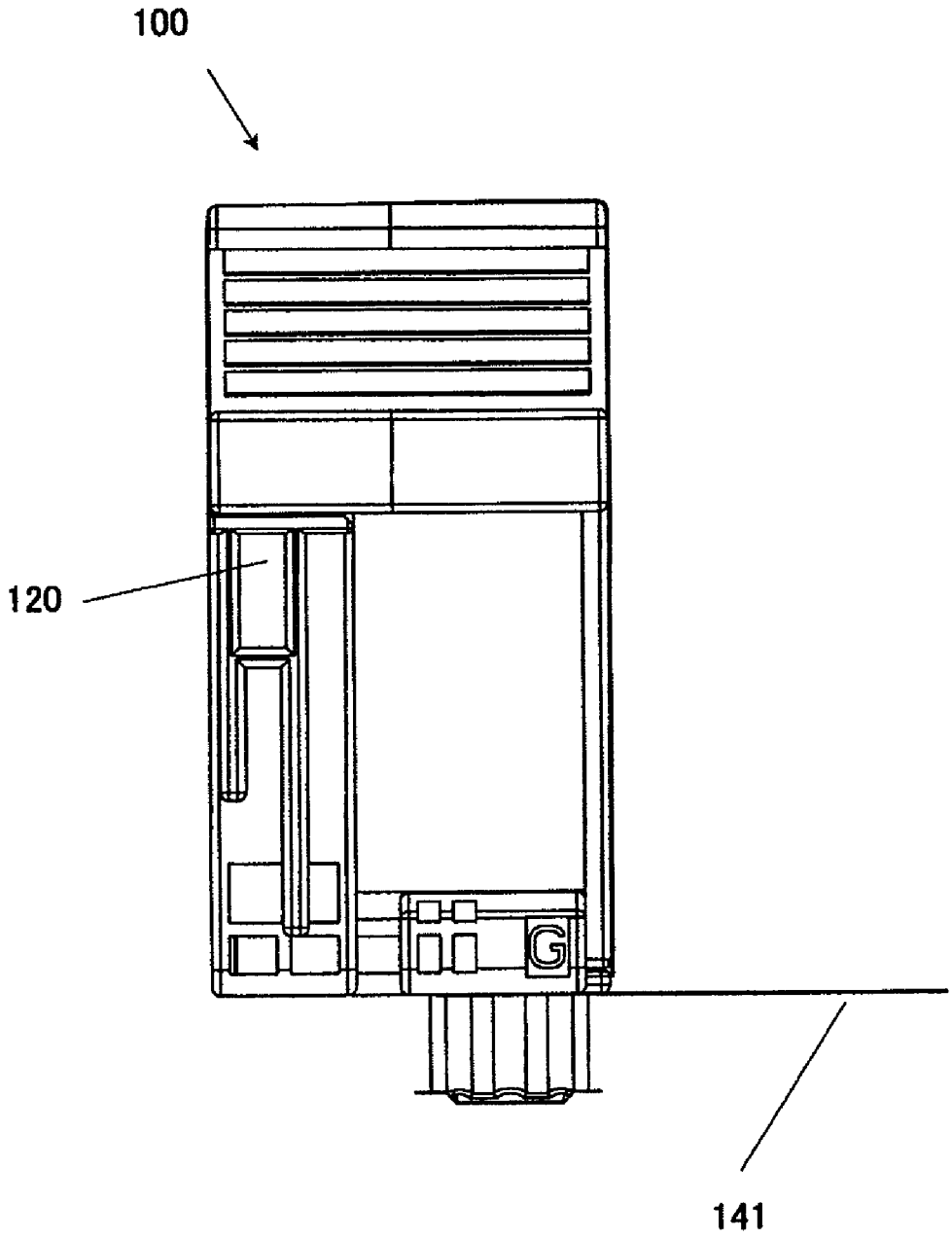
FIG. 12 is a right side view thereof.
Figure 13:
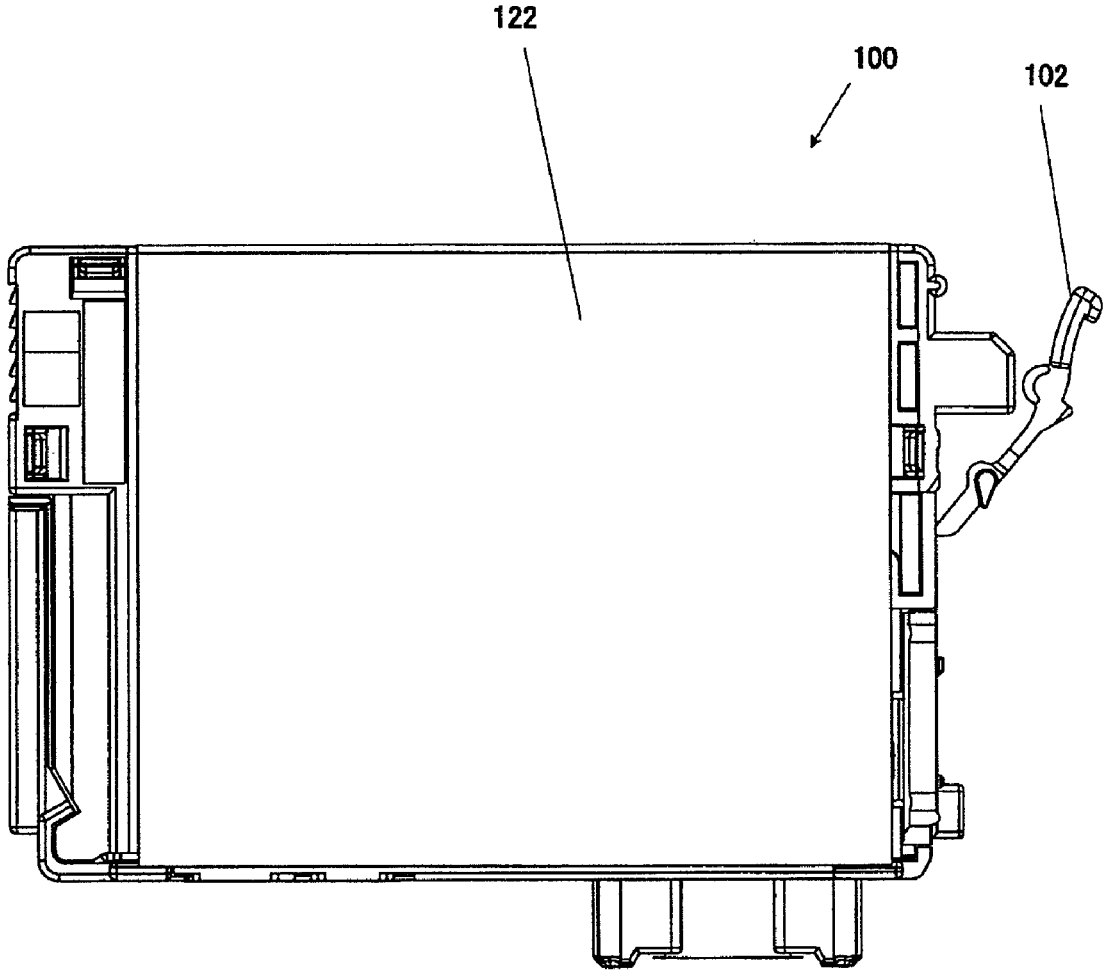
FIG. 13 is a rear view thereof.
Figure 14:
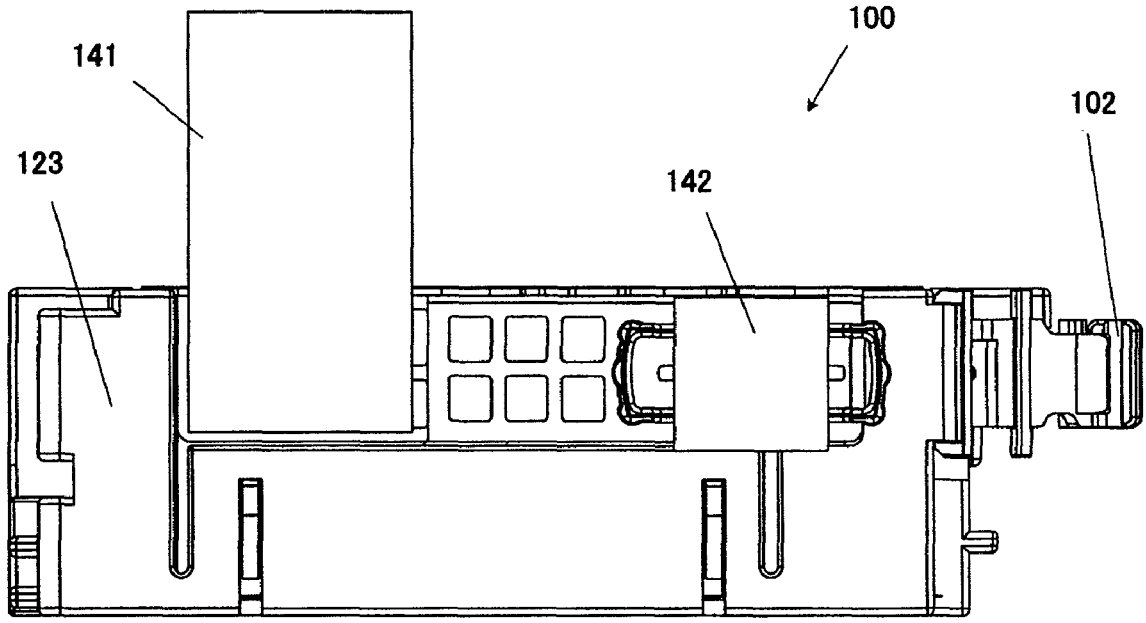
FIG. 14 is a bottom view thereof.
Figure 15:
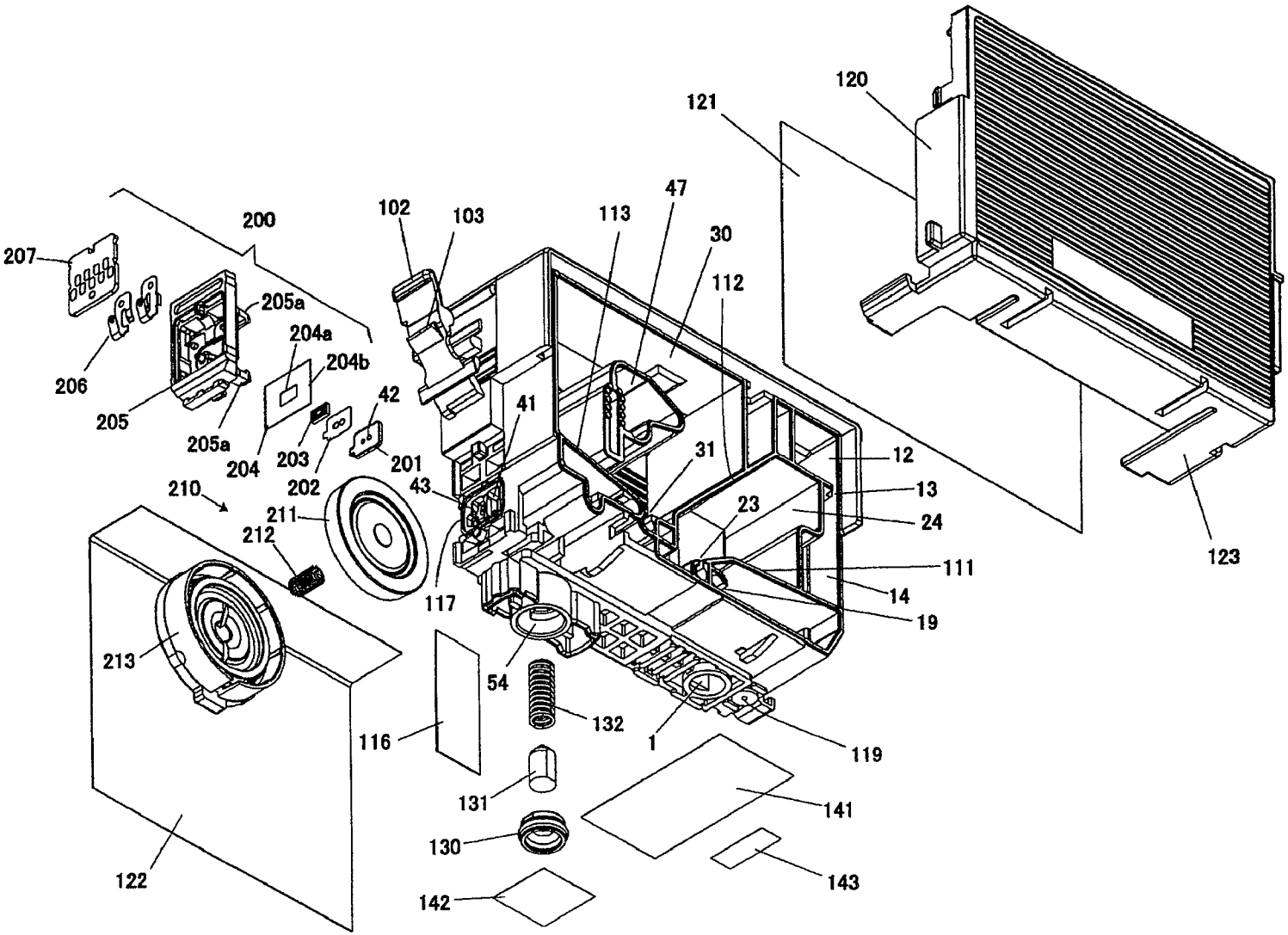
FIG. 15 is an exploded perspective view thereof viewed from the front side.
Figure 16:
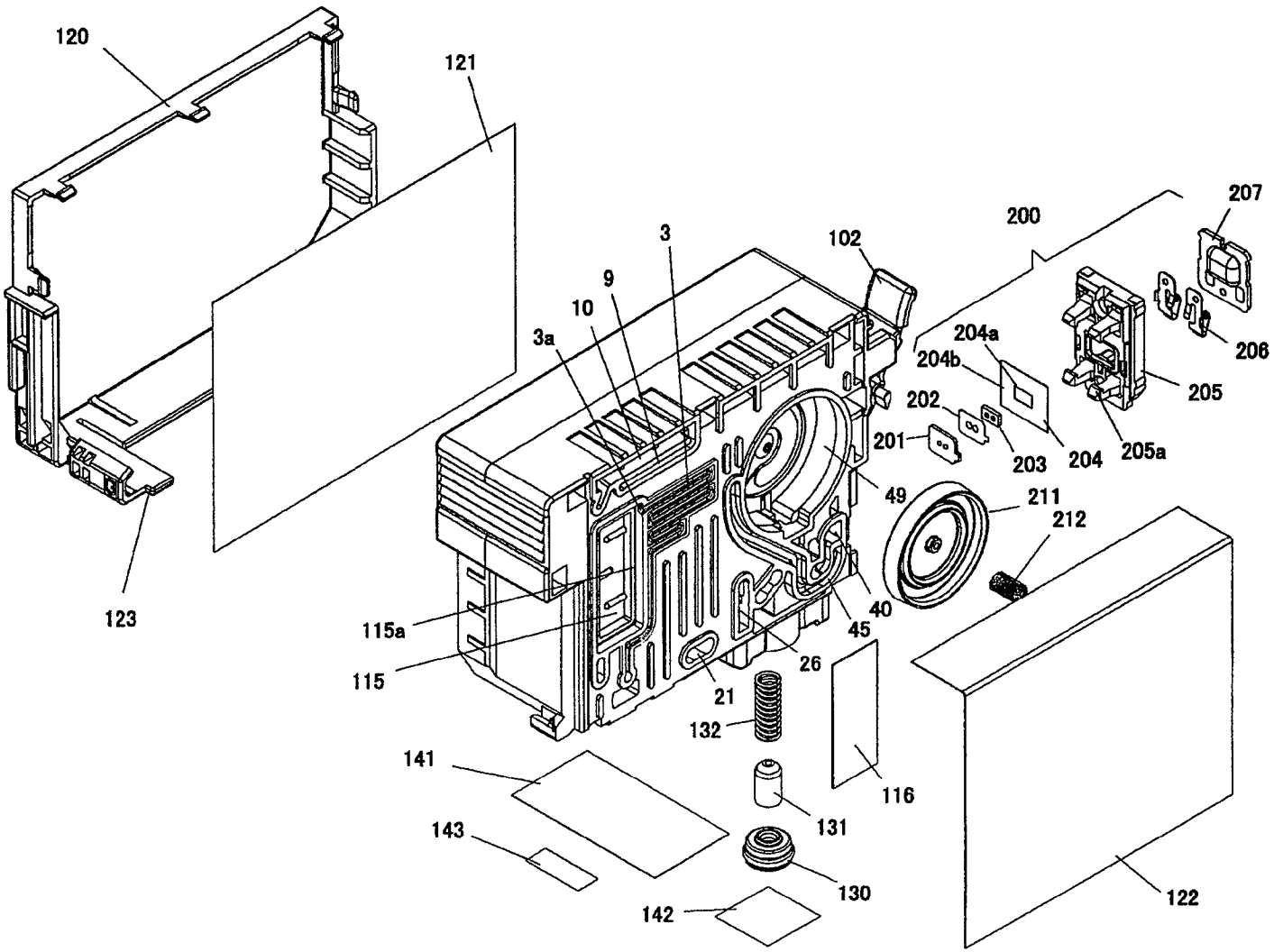
FIG. 16 is an exploded perspective view thereof viewed from the rear side.

FIGS. 1 to 4 respectively depict an ink cartridge in an embodiment of liquid container according to the present invention, shown in external perspective view seen from the front side. FIGS. 5 to 8 respectively depict the ink cartridge of the embodiment in external perspective view seen from the rear side. FIG. 9 is a plan view of the ink cartridge of the embodiment; FIG. 10 is a front view; FIG. 11 is a left side view; FIG. 12 is a right side view; FIG. 13 is a rear view; and FIG. 14 is a bottom view. FIG. 15 is an exploded perspective view of the ink cartridge of the embodiment viewed from the front side; and FIG. 16 is an exploded perspective view of the ink cartridge of the embodiment viewed from the rear side.

(Overview of Ink Cartridge)

The ink cartridge 100 of the present embodiment is a liquid container of generally rectangular parallelepiped shape adapted to collect and/or store liquid (in this instance ink) within an ink storage chamber provided as a liquid storage chamber in its interior. The ink cartridge 100 is adapted to be installed on the carriage of a liquid consuming apparatus, in this instance an inkjet recording device (not shown), in an attitude with its liquid feed hole 54 facing downward (the attitude depicted in FIGS. 1 to 4) so as to supply ink to the inkjet recording device.

The ink cartridge 100 is furnished on its base face 101 with a liquid feed hole 54 (ink feed hole) (see FIG. 20) that connects with the inkjet recording device to supply ink. An air vent hole 1 (see FIG. 20) for introducing outside air into the ink cartridge 100 interior opens onto the base face 101. That is, the ink cartridge 100 is an ink cartridge of outside-vented design whereby air is introduced through the air vent hole 1 while ink is supplied from the liquid feed hole 54.

As depicted in FIGS. 15 and 16, the ink cartridge 100 has a cartridge unit 110 constituting the liquid container, and a cover member 120 adapted to cover the front face side of the cartridge unit 110. In the cartridge unit 110 there are formed partition walls 111 . . . which have various contours at its front side; these partition walls 111 . . . define multiple ink storage chambers (liquid storage chambers) 24, 30 charged with ink. A film 121 adapted to cover the front face side of the cartridge unit 110 is disposed between the cartridge unit 110 and the cover member 120; by welding this film 121 to the tops of the partition walls 111 . . . , the tops of the partition walls 111 . . . are sealed off by the film 121 to form a plurality of flow channels, ink storage chambers, an air chamber, and so on.

As will be discussed in more detail later, at the rear face side of the cartridge unit 110 there are defined a pressure chamber 49 that serves as a differential pressure valve housing chamber; and channels that constitute a plurality of flow channels. With a differential pressure valve 210 and an air-liquid separation chamber 115 in place and an outside face film 122 welded to the outside face, the openings of these channels will be sealed off to form a plurality of flow channels.

A locking lever 102 is disposed on the left face side of the ink cartridge 100. This locking lever 102 has a projection 103 that interlocks with a recess formed on the cartridge when the receptacle is installed on the carriage of the inkjet recording device.

(Detailed Description of Cartridge)

Figure 17:
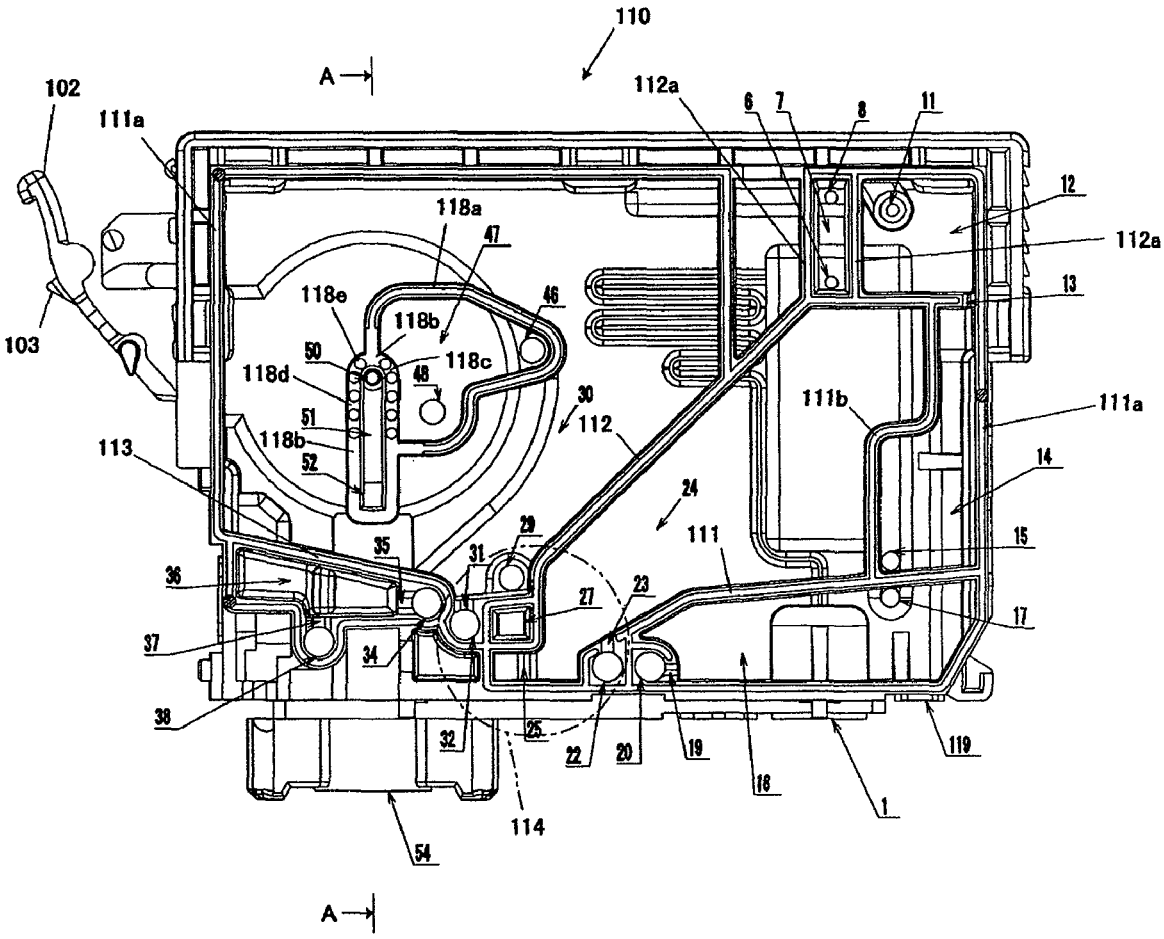
FIG. 17 is a front view of the cartridge unit of the ink cartridge of the embodiment.
Figure 18:
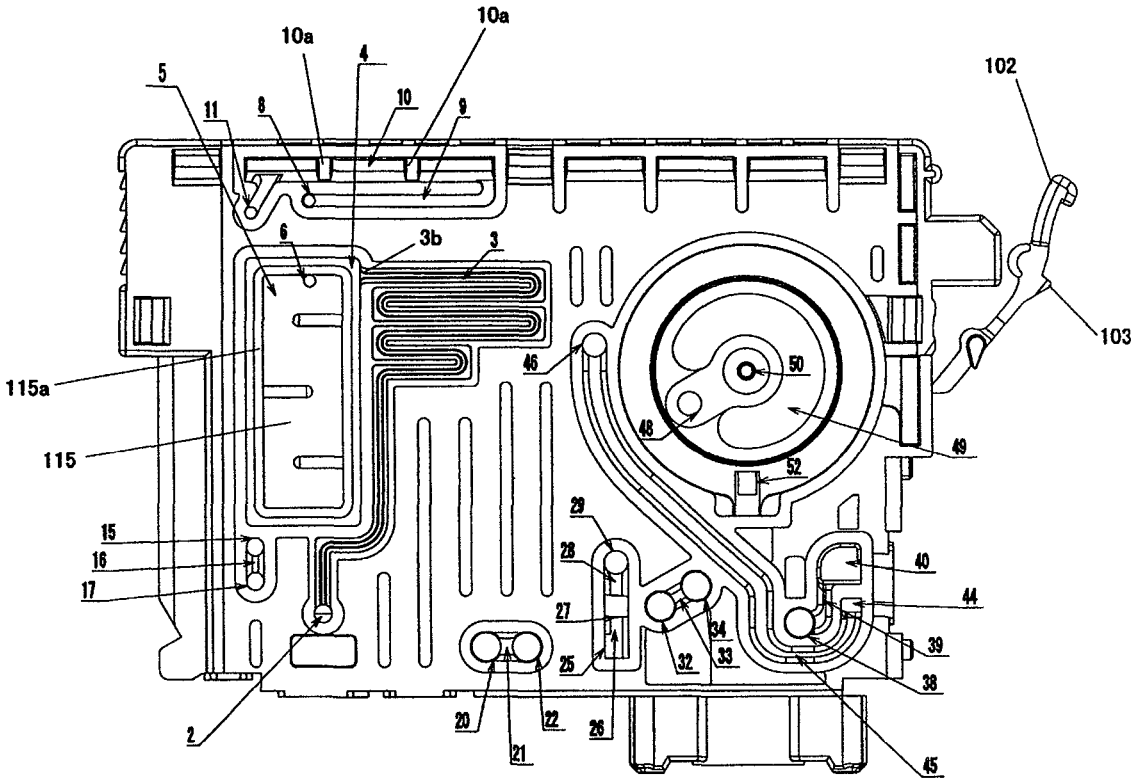
FIG. 18 is a rear view thereof.
Figure 19:
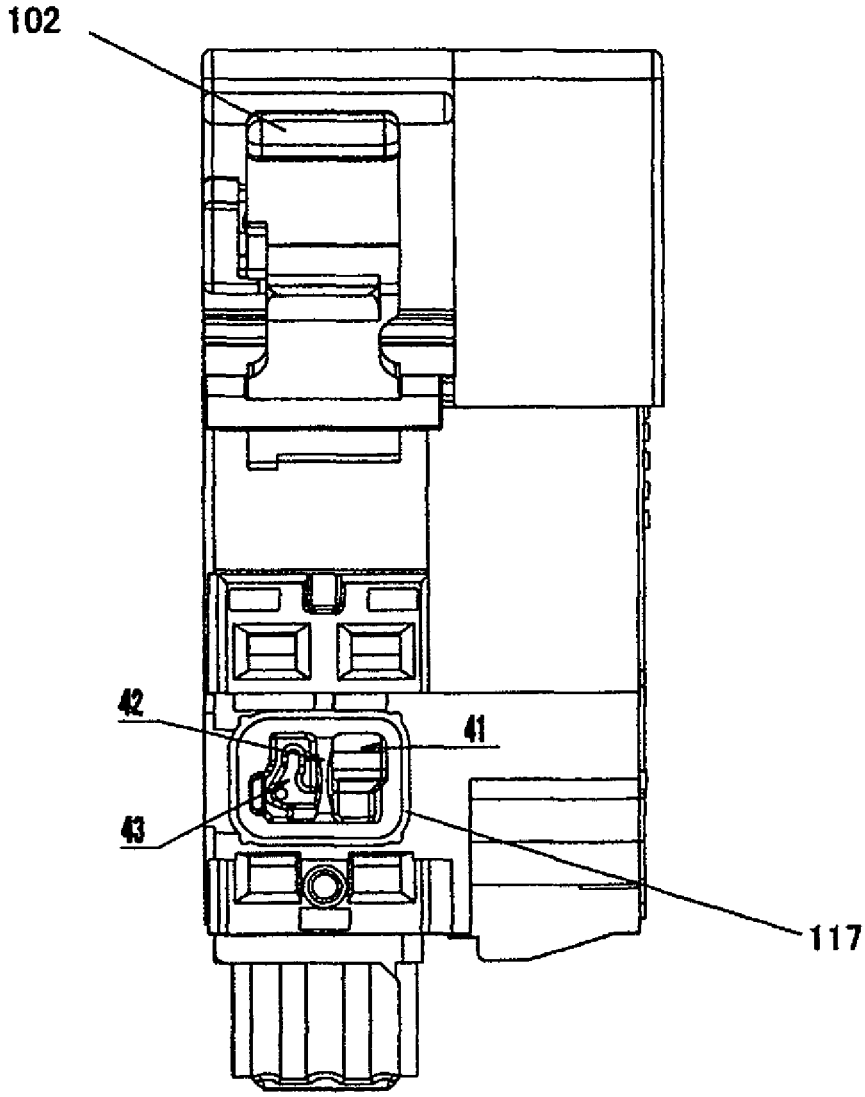
FIG. 19 is a left side view thereof.
Figure 20:
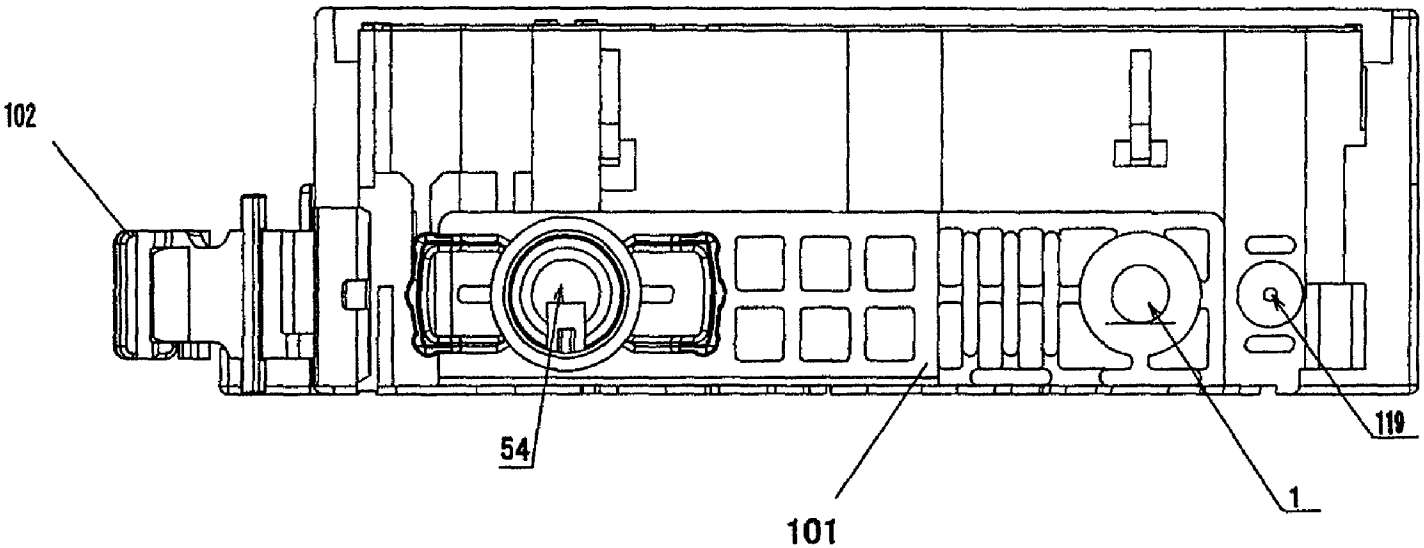
FIG. 20 is a bottom view thereof.
Figure 21:
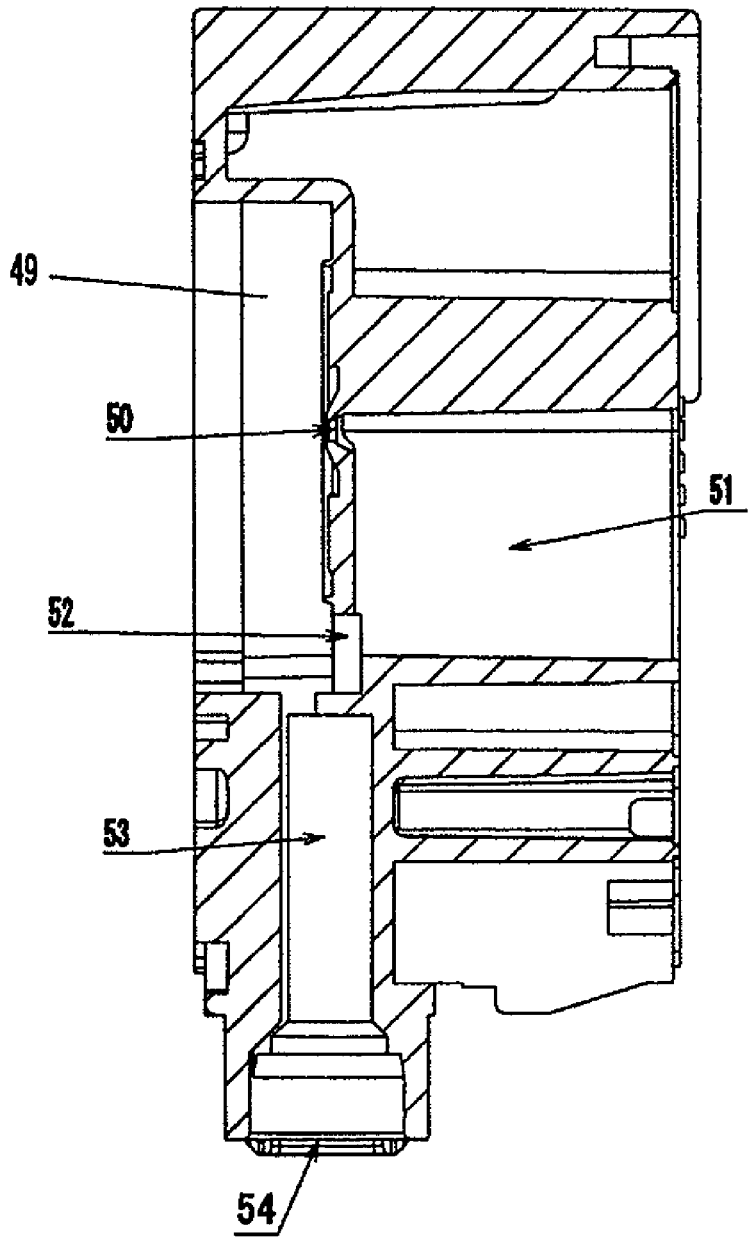
FIG. 21 is an A-A cross section of FIG. 17.

FIG. 17 is a front view of the cartridge unit (receptacle body) 110 of the ink cartridge 100 of the present embodiment; FIG. 18 is a rear view of the cartridge unit 110; FIG. 19 is a left side view of the cartridge unit 110; FIG. 20 is a bottom view of the cartridge unit 110; and FIG. 21 is an A-A cross section of FIG. 17.

This ink cartridge 100 is designed to be detachably installed on a liquid consuming apparatus; as depicted in FIGS. 15 and 17, the interior of the cartridge unit 110, which is designed to be installed on the liquid consuming apparatus for use, is furnished with a liquid storage chamber (24, 30) adapted to accommodate a liquid (in this case, a water based ink); a liquid feed hole 54 adapted to supply the liquid held in the liquid storage chamber to the liquid consuming apparatus; and an air vent hole 1 adapted to introduce outside air into the liquid storage chamber in association with consumption of the liquid inside the liquid storage chamber.

As depicted in FIGS. 15 and 17, the liquid storage chamber (24, 30) is divided into two chambers, namely a first liquid storage chamber 24 situated at an upstream location and a second liquid storage chamber 30 situated at a downstream location, in relation to the direction of flow of the liquid towards the liquid feed hole 54 during service.

As depicted in FIGS. 15 and 17, the receptacle body has partition walls 111 to 113 that define the first and second liquid storage chambers 24, 30. The partition wall 112 is a shared partition wall that divides the first and second liquid storage chambers 24, 30. The partition wall 111 facing this shared partition wall 112 shall be designated as the first partition wall, and the partition wall 113 facing this shared partition wall 112 shall be designated as the second partition wall. In the present embodiment, the partition wall 112 is constituted as a shared partition wall which is shared by the first and second liquid storage chambers 24, 30; however, the chambers could be respectively separated by different partition walls.

At a minimum, the first and second partition walls 111, 113 are sloped such that the distance between the shared partition wall 112 and the partition wall 111, and the distance between the shared partition wall 112 and the partition wall 113, is progressively narrower towards the bottom part of the cartridge unit 110 during service. In FIGS. 15 and 17, the shared partition wall 112 slopes as well, but it could be vertical with respect to the base wall instead. Alternatively, either one of the first and second partition walls 111, 113 could be vertical. Regardless of which design is selected, the liquid storage chambers 24, 30 will have contours that progressively narrow in the horizontal direction towards the lower side in the direction of gravity in the installed attitude.

The first upstream opening 23 of the first liquid storage chamber, the first downstream opening 25 of the first liquid storage chamber, the second upstream opening 29 of the second liquid storage chamber, and the second downstream opening 31 of the second liquid storage chamber are positioned centered towards the narrow-width bottom part side 114 between the first partition wall 111 and the shared partition wall 112, and between the second partition wall 113 and the shared partition wall 112.

Specifically, the dividing and base walls 111 to 113 that define the first and second liquid storage chambers 24, 30 are constituted by partition walls (111 to 113) that as a whole extend radially towards the interior of the cartridge unit 110 from a radial center part 114 that is situated in proximity to the bottom part of the cartridge unit 110 during service; at least the base walls of the first and second liquid storage chambers 24, 30 (here, 111 to 113 which also serve as partition walls; however, one of the partition walls 111 to 113 can also be a vertical wall) are sloped; and the first upstream opening 23 and the first downstream opening 25 in the first liquid storage chamber 24, as well as the second upstream opening 29 and the second downstream opening 31 in the second liquid storage chamber 30, are positioned centered towards the radial center part 114.

Symbols 1 to 54 appended in FIGS. 17 to 21 indicate the various parts inside the cartridge unit 110; at the same time, these symbols 1 to 54 also represent the route along which air or liquid flows (i.e. flow of air or liquid from site 1 to site 54) inside the cartridge unit 110 when the ink cartridge 100 is used, i.e. when the liquid consuming apparatus is being supplied with liquid from the liquid feed hole 54, and accordingly they will be discussed in order beginning from symbol 1.

The air inlet in the air vent hole 1 opens onto the base face of the cartridge unit 110, while the air outlet 2 in the air vent hole 1 opens onto the back face of the cartridge unit 110 (FIG. 18).

A serpentine path 3 communicates with the outlet 2 of the air vent hole 1. The serpentine path 3 is an elongated narrow flow channel that snakes in such a way as to increase the distance from the air vent hole 1 to the first liquid storage chamber 24 and limit evaporation of moisture from the liquid. The terminus 3*b* of the serpentine path 3 opens into the air-liquid separation chamber 115 (FIGS. 16, 18).

The air-liquid separation chamber 115 is designed to prevent ink in the first liquid storage chamber 24 from back flowing and spilling out from the air vent hole 1. A step 115*a* is formed on the inside peripheral wall of the air-liquid separation chamber 115, and the peripheral edge part of an air-liquid separation filter 116 (FIG. 16) is adhered to this step 115*a*. The air-liquid separation chamber 115 is thereby divided by the air-liquid separation filter 116 into a front side space (downstream side 5) and a rear side space (upstream side 4) depicted in FIG. 18.

The air-liquid separation filter 116 is a breathable film made of material through which gases can pass but liquids cannot pass; it can be composed of highly water- and oil-repellant fiber material knitted into a mesh pattern. The terminus 3*b* of the serpentine path 3 opens onto the rear side space 4 (FIG. 18), and a through-hole 6 (FIG. 18) opens into the front side space.

The through-hole 6 opens onto the front face side of the cartridge unit 110 (FIG. 17), and at the front face side of the cartridge unit 110 communicates with a flow channel 7 that is defined by a partition wall 112*a* integral with the partition wall 112. A through-hole 8 communicates with the flow channel 7. The through-hole 8 opens onto the rear face side of the cartridge unit 110 (FIG. 18), and at the rear face side of the cartridge unit 110 communicates with a U-turn channel 9 and 10.

As depicted in FIGS. 18 and 16, in the U-turn channel 9, 10, the flow channel 10 is deeper than the flow channel 9, in relation to the depthwise direction of the cartridge unit 110. As shown in FIG. 18, a plurality of ribs 10*a* that extend in the depthwise direction are formed in the flow channel 10, thereby blocking any liquid that may start to backflow from the first liquid storage chamber 24 side.

The terminus of the U-turn channel 9, 10 communicates with the through-hole 11 (FIGS. 18, 17). The through-hole 11 opens onto the front face side of the cartridge unit 110 (FIG. 17), and at the front face side of the cartridge unit 110 communicates with a first air chamber 12 that is defined by the partition wall 112*a* integral with the partition wall 112 and by a partition wall (which is also the outer wall) 111*a* integral with the partition wall 111.

A notched hole 13 cut into the partition wall is disposed in the lower part of the first air chamber 12; the first air chamber 12 communicates with a second air chamber 14 through this notched hole 13. A through-hole 15 communicates with the lower part of the second air chamber 14. The through-hole 15 opens onto the rear face side of the cartridge unit 110 (FIG. 18), and at the rear face side of the cartridge unit 110 communicates with a through-hole 17 via a flow channel 16.

The through-hole 17 opens onto the front face side of the cartridge unit 110 (FIG. 17), and at the front face side of the cartridge unit 110 communicates with a third air chamber 18 that is defined by the outer wall 111*a* integral with the partition wall 111. The first to third air chambers 12, 14, 18 constitute a trap space adapted to trap liquid in the event that liquid in the liquid storage chamber should start to backflow, for example, due to thermal expansion of air inside the liquid storage chamber or to vibration from the outside, at times that the ink cartridge 100 is kept without being used. The air chamber is divided into the three first to third air chambers, thereby preventing the ink from descending along the edges and leaking out from the air vent hole 1.

One terminus of the third air chamber 18 opens into a through-hole 20 via a flow channel 19. The through-hole 20 opens onto the rear face side of the cartridge unit 110 (FIG. 18), and at the rear face side of the cartridge unit 110 communicates with another through-hole 22 via a flow channel 21. The through-hole 22 opens onto the front face side of the cartridge unit 110 (FIG. 17), and at the front face side of the cartridge unit 110 communicates via the first upstream opening 23 with the first liquid storage chamber 24 which is defined by the partition walls 111, 112 and the partition wall 111*b* integral therewith. When the ink cartridge 100 is placed in service, the first upstream opening 23 will serve as an inlet into the first liquid storage chamber 24 for air introduced from the air vent hole 1. As depicted in FIG. 17, the first upstream opening 23 opens upward inside the first liquid storage chamber 24. The first upstream opening 23 is sufficiently narrow to permit a meniscus to form.

The first downstream opening 25 is disposed on the narrow-width bottom part 114 at the lowermost end of the first liquid storage chamber 24. This first downstream opening 25 serves as an outlet for liquid or air from the first liquid storage chamber 24. The first downstream opening 25 will serve as an outlet for liquid while liquid is present in the first liquid storage chamber 24, and as an outlet for air when no more liquid is left in the first liquid storage chamber 24. The first downstream opening 25 opens rightward (rightward in FIG. 17) inside the first liquid storage chamber 24. The flow channel 25 opens onto the rear face side of the cartridge unit 110 (FIG. 18), and at the rear face side of the cartridge unit 110 communicates with the second upstream opening 29 (which is a through-hole) via the flow channels 26, 27, 28.

The second upstream opening 29 opens onto the front face side of the cartridge unit 110 (FIG. 17), and at the front face side of the cartridge unit 110 opens into the second liquid storage chamber 30 which is defined by the partition walls 112, 113 and the outer wall 111*a*. When the ink cartridge 100 is placed in service, the second upstream opening 29 serves as an inlet into the second liquid storage chamber 30 for liquid or air from the first liquid storage chamber 24. The second upstream opening 29 will serve as an inlet for liquid while liquid is present in the first liquid storage chamber 24, and as an inlet for air when no more liquid is left in the first liquid storage chamber 24.

In the bottom part 114 at the lowermost end of the second liquid storage chamber 30 there is provided a through-hole 32 via the second downstream opening 31. This second downstream opening 31 serves as an outlet for liquid or air from the second liquid storage chamber 30. The second downstream opening 31 will serve as an outlet for liquid while liquid is present in the second liquid storage chamber 30, and as an outlet for air when no more liquid is left in the second liquid storage chamber 30. The through-hole 32 opens onto the rear face side of the cartridge unit 110 (FIG. 18), and at the rear face side of the cartridge unit 110 communicates with a through-hole 34 via a flow channel 33. The through-hole 34 opens onto the front face side of the cartridge unit 110 (FIG. 17), and at the front face side of the cartridge unit 110 communicates with a through-hole 38 via flow channels 35, 36, 37.

The through-hole 38 opens onto the rear face side of the cartridge unit 110 (FIG. 18), and at the rear face side of the cartridge unit 110 communicates via flow channels 39, 40 with flow channels 41, 43 that open onto the left side face of the cartridge unit 110 (FIG. 19). The flow channels 41, 43 constitute flow channels for sensing remaining liquid level, whose openings on the left side face are closed off by a liquid sensing device 200 (see FIG. 2).

As depicted in FIGS. 15 and 16, the liquid sensing device 200 is a device of known design. The liquid sensing device 200 includes a sensor plate, e.g. an SUS plate 201; a film 202; a sensor chip 203 that includes a piezoelectric element; a film 204; a sensor cover 205; a pair of terminals 206; and a board module 207. The sensor chip 203 is bonded to the SUS plate 201 through the agency of the film 202. An opening rim 204*a* in the film 204 is welded to the SUS plate 201, and the outside peripheral edge 204*b* of the film 204 is welded to a welding rib 117 disposed about the left side face openings of the flow channels 41, 43, thereby positioning the sensor chip 203 facing the flow channels 41, 43, as well as blocking off the left side face openings of the flow channels 41, 43 with the film 204.

A pair of holes provided in the SUS plate 201 and the film 202 and liquid introduction holes inside the sensor chip 203 define a flow channel 42 that connects the flow channels 41, 43; the sensor chip 203 is adapted to sense whether liquid is present in this flow channel 42. Once liquid is no longer sensed by the sensor chip 203, it will be decided that the liquid consuming apparatus (e.g. the inkjet recording device) has fallen below a prescribed value for remaining liquid level.

The pair of terminals 206 and the board module 207 are installed on the sensor cover 205, and a hook provided to the sensor cover 205 is engaged by the cartridge unit 110 to install the sensor cover 205 (and hence the pair of terminals 206 and the board module 207) to the cartridge unit 110. When the ink cartridge 100 is installed in the liquid consuming apparatus, the sensor chip 203 will be electrically connected to the liquid consuming apparatus via the pair of terminals 206 and the board module 207.

As depicted in FIG. 18, a flow channel 44 communicates with the flow channel 43. This flow channel 44 serves as an outlet for liquid or air from the flow channel 43. The flow channel 44 communicates with a through-hole 46 via a flow channel 45. The through-hole 46 passes through the front face side of the cartridge unit 110 (FIG. 17), and opens into a buffer chamber 47 that is defined by partition walls 118*a* and 118*b* inside the second liquid storage chamber 30. The buffer chamber 47 collects liquid for use after liquid is no longer sensed by the sensor chip 203.

A through-hole 48 is disposed in the lower part of the buffer chamber 47. The through-hole 48 opens onto the rear face side of the cartridge unit 110 (FIG. 18), and at the rear face side of the cartridge unit 110 communicates with the pressure chamber 49. A through-hole 50 is provided in the radial center part of the pressure chamber 49. The through-hole 50 opens onto the front face side of the cartridge unit 110 (FIG. 17), and inside the second liquid storage chamber 30 communicates with a flow channel 51 (see FIG. 21) that is defined by the partition wall 118*b*. A through-hole 52 is provided in the lower part of the flow channel 51 as depicted in FIG. 17. As shown in FIG. 21, the through-hole 51 communicates with a flow channel 53, and the flow channel 53 communicates with the liquid feed hole 54.

As illustrated in FIGS. 15 and 16, the pressure chamber 49 constitutes a pressure differential valve chamber provided as a recessed part adapted to accommodate the pressure differential valve 210. A valve body 211, a spring 212, and a valve seat 213 are housed within the pressure chamber 49 to construct the pressure differential valve 210. The pressure differential valve 210 is situated between the downstream liquid feed hole 54 and the upstream liquid storage chamber 30, and is designed to bring the ink being supplied to the liquid feed hole 54 to negative pressure by reducing the pressure on the downstream side relative to the upstream side.

As depicted in FIGS. 15 and 16, the interior of the liquid feed hole 54 is furnished with a seal member 130 of annular shape adapted to press against the outside surface of a liquid feed needle (not shown) of the liquid consuming apparatus when the ink cartridge 100 is installed on a liquid consuming apparatus; a valve 131 adapted to abut the seal member 130 and block off the liquid feed hole 54 when the ink cartridge is not installed on a liquid consuming apparatus; and a compression spring 132 adapted to urge the valve 131 in the direction pressing it against the seal member 130. When the ink cartridge 100 is installed on a liquid consuming apparatus (not shown), the liquid feed needle provided to the liquid consuming apparatus will pierce a sealing film 142 and slip into the liquid feed hole 54, whereupon the inside perimeter of the seal member 130 and the outside perimeter of the liquid feed needle will become sealed to produce a liquid-tight seal at the interstice of the liquid feed hole 54 and the liquid feed needle. The distal end of the liquid feed needle will come into abutment against the valve 131 and push the valve 131 upward and break the seal between the valve 131 and the seal member 130, so that liquid can now be supplied to the liquid feed needle from the liquid feed hole 54.

In FIGS. 17 and 20, a depressurization hole 119 opens into the third air chamber 18. The depressurization hole 119 is utilized when charging liquid to the cartridge unit 110.

(Ink Cartridge 100 Manufacturing Method)

The ink cartridge 100 is manufactured in the following manner.

(1) The cartridge unit 110 is manufactured without the cover member 120 installed. At this point, the rear face of the cartridge unit 110 is sealed off by the outside face film 122, while the front face is sealed off by the film 121. However, the partition wall 118*b* is left in the unwelded state with respect to the film 121. Consequently, flow channels 118*c*, 118*d* are defined between the partition wall 118*b* and the film 121. These flow channels 118*c*, 118*d* are ensured by gaps between a plurality of land portions 118*e* formed on the upper face of the partition wall 118*b*.

(2) The cartridge unit 110 is positioned upside down (in the present embodiment, with the liquid feed hole 54 upward), and a liquid injection device is used to charge the liquid to the ink cartridge 100.

Figure 22:
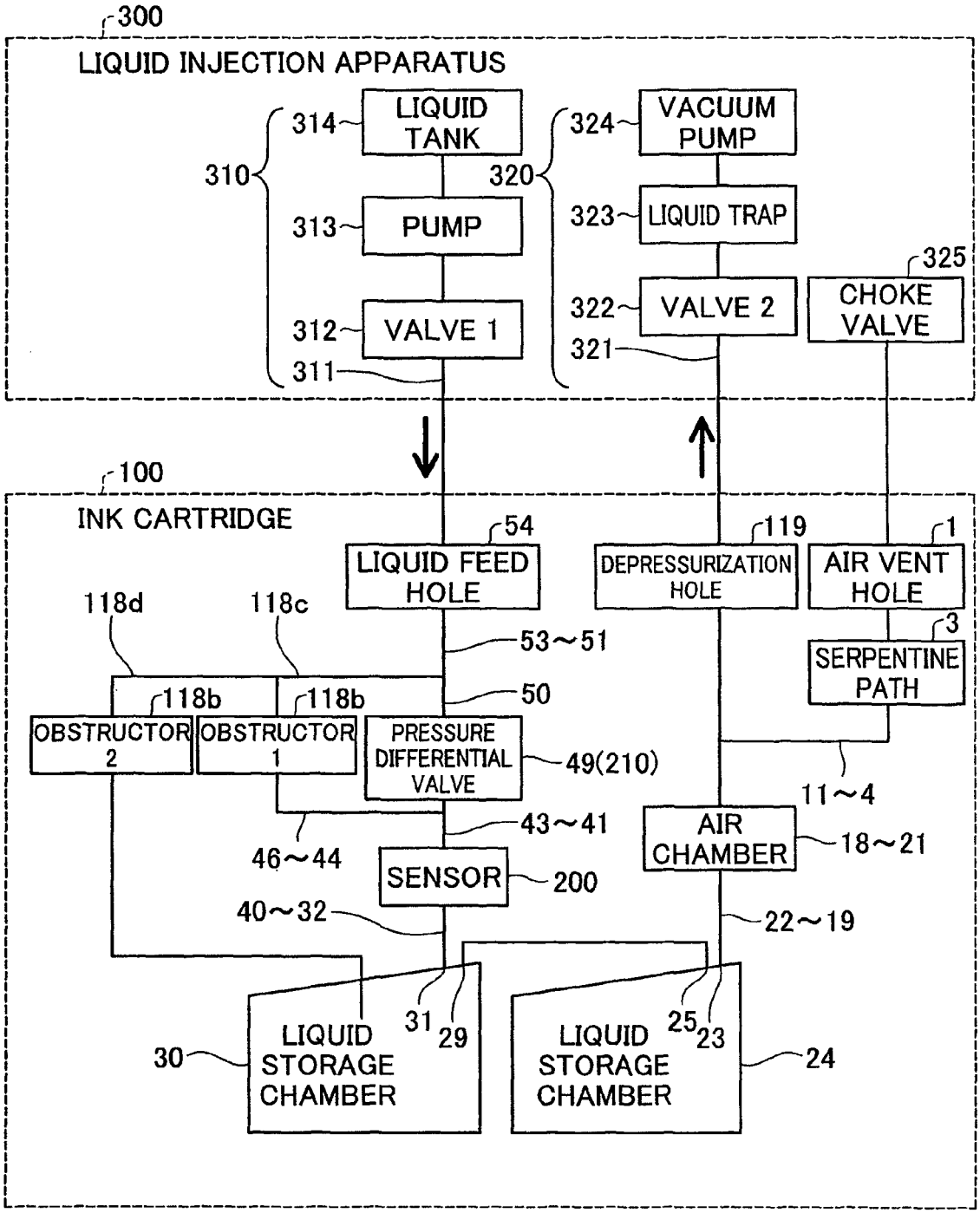
FIG. 22 is a system diagram depicting a liquid charging system, and showing liquid and air flows during liquid charging.

FIG. 22 is a system diagram depicting a liquid charging system, and shows the flows of liquid and air during charging of liquid. In FIG. 22, parts equivalent to parts discussed previously are assigned like symbols. In FIG. 22, 300 is a liquid injection device. In the liquid injection device 300, a liquid feed tube 311 of liquid feed means 310 and a vacuum suction tube 321 of vacuum suction means 320 are provided as separate elements, with the liquid feed tube 311 adapted to connect to the liquid feed hole 54 of the ink cartridge, and the vacuum suction tube 321 adapted to connect to the depressurization hole 119.

The liquid feed means 310 has a design furnished with an on-off valve 312 for opening and closing the liquid feed tube 311 which communicates with the liquid feed hole 54, and a pump 313 for pressure-feeding liquid stored in a liquid tank 314 to the liquid feed tube 311, and adapted to shut off the feed of liquid through on-off operation of the on-off valve 312.

The vacuum suction means 320 has a design furnished with an on-off valve 322 for opening and shutting the vacuum suction tube 321 which communicates with the depressurization hole 119; a vacuum pump 324 for creating a vacuum via the vacuum suction tube 321; and, disposed between the on-off valve 322 and the vacuum pump 324, a liquid trap 323 for collecting liquid in the event that liquid has flowed into the vacuum suction tube 321 due to some problem; and is adapted to shut off vacuum suction through on-off operation of the on-off valve 322. The vacuum suction means 320 also has a choke valve 325 for connection to the air vent hole 1.

Charging of liquid to the ink cartridge is carried out in the following manner. First, the air vent hole 1 is temporarily shut using the choke valve 325. The on-off valve 312 of the liquid feed means 310 connected to the liquid feed hole 54 is shut, the on-off valve 322 of the vacuum suction means 320 connected to the depressurization hole 119 is opened, and the interior of the cartridge unit 110 is depressurized to a prescribed pressure by vacuum suction from the depressurization hole 119.

Next, once the interior of the cartridge unit 110 has reached prescribed pressure, the on-off valve 322 of the vacuum suction means 320 is shut, the on-off valve 312 of the liquid feed means 310 is opened, and feed of liquid to the liquid feed hole 54 is initiated to charge a prescribed amount of liquid to the liquid storage chambers 24, 30 inside the cartridge unit 110.

During charging of liquid to the cartridge unit 110, liquid or air will backflow through the flow channels 1 to 54 discussed previously, i.e. liquid or air will flow towards the air vent hole 1 from the liquid feed hole 54; the amount of charged liquid will be such that liquid inflowing to the cartridge unit 110 from the liquid feed hole 54 completely fills the second liquid storage chamber 30, and only partly fills the first liquid storage chamber 24.

When liquid flows towards the second liquid storage chamber 30 and the first liquid storage chamber 24 from the liquid feed hole 54, since the pressure differential valve 210 acts as a check valve, even if the partition wall 118*b* and the film 121 were completely welded, liquid attempting to flow from the liquid feed hole 54 to the pressure chamber 49 via the flow channels 53, 52, 51 will be intercepted by the pressure differential valve 210 and prevented from flowing further forward.

In the present embodiment however, as discussed in the preceding section (1), the partition wall 118*b* and the film 121 have been left in the unwelded state, and flow channels (bypass channels) 118*c*, 118*d* are defined between the partition wall 118*b* and the film 121. Consequently, liquid which has reached the flow channel 51 from the liquid feed hole 54 via the flow channels 53, 52 will not proceed towards the flow channel 50 and the pressure chamber 49, but will instead flow from the flow channel 51 through the flow channels 118*c*, 118*d* serving as first and second bypasses, then flow directly from the flow channel 118*c* (first bypass) into the buffer chamber 47, and flow directly from the flow channel 118*d* (second bypass) into the second liquid storage chamber 30. The liquid entering the buffer chamber 47 will then flow through the flow channels 46 to 44 to reach the flow channels 43 to 41 for the liquid sensing device 200; and then flow through the flow channels 40 to 32 and into the second liquid storage chamber 30 from the downstream opening 31.

Once the second liquid storage chamber 30 becomes filled with liquid, liquid will pass from the second upstream opening 29 situated in the bottom part of the second liquid storage chamber 30 (which is its top part during liquid charging) through the flow channels 28 to 26 and then flow into the first liquid storage chamber 24 from the first downstream opening 25. The liquid charging operation will conclude at a point in time that the first liquid storage chamber 24 has become partially filled with liquid.

Subsequently, as depicted in FIGS. 15 and 14, the air vent hole 1 will be sealed by a sealing film 141, the liquid feed hole 54 will be sealed by a sealing film 142, and the depressurization hole 119 will be sealed by a sealing film 143, respectively. The unwelded portion (obstructing means) of the partition wall 118*b* and the film 121 will then be welded, and the cover member 120 will be installed on the cartridge unit 110 to complete the ink cartridge 100 constituting the liquid container herein. The sealing film 143 of the depressurization hole 119 will be covered by the base plate 123 of the cover member 120, making it impossible for the user to peel it off by mistake.

(Ink Cartridge 100 Service Condition)

When the ink cartridge 100 is to be placed in service, after the user has peeled off the sealing film 141 of the air vent hole 1, the ink cartridge 100 will be installed in the liquid consuming apparatus, thus making it possible for the liquid consuming apparatus to be supplied with liquid from the liquid feed hole 54. As the liquid is consumed by the liquid consuming apparatus and the pressure inside the ink cartridge 100 drops, air in an amount commensurate with the decrease in stored liquid will inflow to the first liquid storage chamber 24 through the flow channels 2 to 23. As liquid continues to be consumed to the point that no liquid remains in the first liquid storage chamber 24, air entering from the air vent hole 1 will flow from first liquid storage chamber 24 into the second liquid storage chamber 30 through the flow passages 25 to 29.

As liquid continues to be consumed further to the point that no liquid remains in the second liquid storage chamber 30 and air bubbles become entrained into the second downstream opening 31 which is the outlet for the liquid from the second liquid storage chamber 30, when these bubbles reach the flow channels 41, 42 for the liquid sensing device 200, the bubbles will be sensed by the liquid sensing device 200 which will determine that no useable liquid remains in the ink cartridge 100. The liquid consuming apparatus will then alert the user of the sensor results through display means or the like, to prompt the user to replace the ink cartridge 100.

(Effects of the Present Embodiment)

(a) By dividing the liquid storage chamber into at least two chambers, namely the first liquid storage chamber 24 situated on the upstream side and the second liquid storage chamber 30 situated on the downstream side in relation to the direction of flow of liquid towards the liquid feed hole 54 during service, air bubbles will not readily infiltrate through the liquid feed hole even if the ink cartridge 100 is subjected to shock due to being dropped, for example.

Moreover, because the dividing and base walls 111 to 113 that define the first and second liquid storage chambers 24, 30 are constituted by partition walls (111 to 113) that as a whole extend radially towards the interior of the receptacle body from the radial center part 114 situated in proximity to the bottom part of the cartridge unit 110 during service, and at least the base walls of the first and second liquid storage chambers 24, 30 are sloped, while the first upstream opening 23 and the first downstream opening 25 in the first liquid storage chamber 24, as well as the second upstream opening 29 and the second downstream opening 31 in the second liquid storage chamber 30, are positioned centered towards the radial center part 114, when the cartridge is installed on the liquid consuming apparatus for service, liquid drainage will be improved and liquid intended for consumption will not easily remain in the liquid storage chambers 24, 30. Furthermore, because the first upstream opening 23 and the first downstream opening 25 situated in the first liquid storage chamber 24, and the second upstream opening 29 and the second downstream opening 31 situated in the second liquid storage chamber 30, are positioned centered towards the radial center part 114, it will be possible for the first downstream opening 25 and the second upstream opening 29 of the flow channel connecting the first liquid storage chamber 24 with the second liquid storage chamber 30 to be disposed closer together. Thus, even where the liquid level inside the liquid container fluctuates with consumption of the liquid by the liquid consuming apparatus, fluctuations in liquid pressure at the liquid feed hole can be limited. Also, flow channel resistance to liquid flowing from the second liquid storage chamber 30 towards the first liquid storage chamber 24 can be reduced when the first and second liquid storage chambers 24, 30 are charged with liquid, making rapid charging possible.

Additionally, by situating the first upstream opening 23, the first downstream opening 25, the second upstream opening 29, and the second downstream opening 31 centered towards the narrow-width bottom part 114, it will be possible to minimize fluctuations in static head caused by fluctuations in liquid level, and particularly fluctuations in static head occurring when the liquid level moves from the first liquid storage chamber 24 to the second liquid storage chamber 30, and to stabilize liquid feed pressure. Also, during charging, remaining air can be minimized, and liquid from can be prevented from spurting out from the air vent hole 1.

From the above it will be appreciated that according to this liquid container, charging of liquid can take place rapidly during charging; infiltration by air bubbles through the liquid feed hole may be largely prevented even where the receptacle is subjected to shock after charging; and liquid intended for consumption may be largely prevented from remaining in the liquid storage chamber when installed for service on a liquid consuming apparatus.

Additionally, this liquid container affords working effects such as the following. Where the liquid is a water-based liquid (e.g. a water-based ink), if the water-based liquid freezes it will expand in volume. Since the second liquid storage chamber 30 is initially completely filled with liquid, if liquid in an amount equivalent to expansion with freezing does not escape to the first liquid storage chamber 24, there is a risk that the liquid container will rupture and the liquid will leak out. On the other hand, according to this liquid container, because the openings 25, 29 connecting the first and second liquid storage chambers 24, 30 are positioned centered towards the radial center part 114, as a result, the flow channel connecting the first liquid storage chamber 24 with the second liquid storage chamber 30 can be shorter, and liquid in an amount equivalent to expansion with freezing can reliably escape to the first liquid storage chamber, preventing the receptacle from rupturing.

(b) Of the openings of the first and second liquid storage chambers 24, 30, the first downstream opening 25 and the second upstream opening 29 of the flow channel that interconnects the first liquid storage chamber 24 and the second liquid storage chamber 30 are disposed closest to the center at the radial center part 114, whereby the first downstream opening 25 and the second upstream opening 29 can be positioned closest together, affording further reduction in flow channel resistance to liquid flowing from the second liquid storage chamber 30 towards the first liquid storage chamber 24 during charging with the liquid. Moreover, when frozen, liquid in an amount equivalent to expansion with freezing can more reliably escape to the first liquid storage chamber 24 so that the receptacle can be prevented from rupturing.

(c) Because an air chamber for trapping liquid that attempts to backflow from the first liquid storage chamber 24 towards the air vent hole 1 is disposed between the first liquid storage chamber 24 and the air vent hole 1, by situating the first upstream opening 23 to the bottom part side of the first liquid storage chamber 24, the downstream opening 19 of the air chamber can be situated on the bottom side of the air chamber. Thus, even if liquid has backflowed into the air chamber 18, the liquid which has backflowed into the air chamber 18 during consumption of the liquid by the liquid consuming apparatus can be recovered in the first liquid storage chamber 24, thus reducing the amount of wasted liquid that cannot be used.

(d) At least a portion of the partition wall 111 that defines the top face of the air chamber 18 can be a partition wall identical to the partition wall 111 defining the first or second liquid storage chamber (in this instance, the first liquid storage chamber 24). By so doing, wasted space inside the liquid container can be minimized, and the liquid container can be made more compact.

(e) By providing a pressure differential valve 210 disposed between the second downstream opening 31 and the liquid feed hole 54 and adapted to regulate pressure of the liquid; bypass flow channels 118*c*, 118*d* for bypassing the pressure differential valve 210 during charging of liquid to the liquid storage chamber; and obstructing means for obstructing the bypass flow channels subsequent to charging with liquid, the pressure of the liquid can be regulated by the pressure differential valve 210. However, since the pressure differential valve also functions as a check valve, absent any additional measures it will not be possible to charge liquid from the feed hole 54 during charging. With this liquid container, however, because bypass flow channels have been provided for bypassing the pressure differential valve 210 during charging of liquid to the liquid storage chambers 24, 30, the liquid can be charged through these bypass flow channels. These bypass flow channels will be obstructed upon completion of charging.

Additionally, with this liquid container, during charging, liquid that has flowed out directly into the second liquid storage chamber 30 from at least part of the bypass flow channel will be charged to the first liquid storage chamber 24 through the second upstream opening 29 and the first downstream opening 25, thereby allowing the liquid to be charged more rapidly.

(f) Because the method for manufacturing the liquid container includes the steps of orienting the liquid container in an attitude so that the bottom part thereof faces upward; filling the second liquid storage chamber 30 with liquid via the liquid feed hole 54; and charging the first liquid storage chamber 24 with liquid from the second liquid storage chamber 30 via the second upstream opening 29 and the first downstream opening 25, flow channel resistance to liquid flowing from the second liquid storage chamber 30 towards the first liquid storage chamber 24 can be reduced during charging of liquid to the first and second liquid storage chambers 24, 30, making rapid charging possible.

In an attitude upside down relative to the attitude when installed on the liquid consuming apparatus, the second upstream opening 29 will be positioned at the uppermost part of the second liquid storage chamber 30. Thus, when charging liquid to the second liquid storage chamber 30 from the second downstream opening 31, the second liquid storage chamber 30 can be filled up with the liquid. A compact liquid container devoid of wasted space can be obtained thereby. Moreover, air bubbles will not infiltrate into the liquid feed hole, even when subjected shock due to being dropped, for example.

Moreover, because the second liquid storage chamber 30 becomes progressively narrower in the horizontal direction going towards the lower side in the direction of gravity in the installed attitude, in an attitude upside down relative to the installed attitude, the second liquid storage chamber will now become progressively narrower in the horizontal direction going towards the upper side in the direction of gravity. Consequently, when the second liquid storage chamber 30 is filled with liquid, any air bubbles remaining in the second liquid storage chamber 30 can be easily expelled through the second upstream opening 29. The second liquid storage chamber 30 can therefore be filled with liquid without any residual air bubbles.

Also, in this attitude, the first upstream opening 23 will be positioned at the uppermost part of the first liquid storage chamber 24. Thus, when charging liquid to the first liquid storage chamber from the first downstream opening 25, liquid will not readily infiltrate into the first upstream opening even if the liquid should rise due to charging. Thus, leakage of liquid from the air vent hole 1 due to liquid infiltrating into the air chamber 18 can be prevented.

Additionally, because the first liquid storage chamber 24 progressively narrows in the horizontal direction going towards the lower side in the direction of gravity in the installed attitude, in an attitude upside down relative to the installed attitude, the first liquid storage chamber will now have progressively narrower contours in the horizontal direction going towards the upper side in the direction of gravity. Thus, when charging of liquid is halted with the liquid level some distance away from the first upstream opening 23 in order to prevent liquid from infiltrating into the air chamber 18 during charging, the volume of this unfilled section of the first liquid storage chamber 24 can be minimized. A compact liquid container devoid of wasted space can be obtained thereby.

While a preferred embodiment has been described in detail hereinabove, numerous variations will be readily apparent to the practitioner of the art without substantially departing from the novelty and effects of the present invention. Accordingly, such valiations will fall within the scope of the present invention. For example, terms that in at least one instance appear together with different terms of broader or identical meaning in the specification and drawings may be replaced with these different terms, at any point in the specification or drawings.

The liquid container of the present invention is not limited to application in ink cartridges for use in ink-jet recording devices. It may be adapted for use in liquid consuming apparatus of various kinds equipped with a liquid jetting head adapted to eject small amounts of a liquid in drop form. Herein, a drop refers to a state of a liquid as ejected from the liquid consuming apparatus, and includes granular, teardrop, or filiform shape with a tail.

Specific examples of liquid consuming apparatus include devices equipped with a coloring matter jetting head used to manufacture color filters for liquid crystal displays or the like; devices equipped with an electrode material (electrode paste) jetting head used to produce electrodes for organic EL displays, field emission displays (FED) or the like; devices equipped with a bioorganic substance jetting head used for biochip manufacture; devices equipped with a specimen jetting head as a precision pipette; textile printing devices; and microdispensers.

In the present invention, a liquid refers to any material capable of being jetted from a liquid consuming apparatus. Inks like that described in the preceding embodiment are typical examples of such liquids. Here, the term ink is used to include ordinary water base and oil base inks, as well as shellac, hot melt inks, and various other kinds of liquid compositions. The liquid could also be a liquid crystal or other substance besides materials employed for printing of text and images. In the present invention, the liquid is not limited to a liquid as one state of matter, and may also be a liquid as one state of matter incorporating a solid such as pigments or metal particles. The liquid storage chamber may be divided into three or more chambers.

While the technology pertaining to the invention have been shown and described on the basis of the embodiments and variations, the embodiments of the invention described herein are merely intended to facilitate understanding of the invention, and implies no limitation thereof. Various modifications and improvements of the invention are possible without departing from the spirit and scope thereof as recited in the appended claims, and these will naturally be included as equivalents in the invention.

What is claimed is:

1. A liquid container attachable to a liquid consuming apparatus, the liquid container having substantially rectangular parallelepiped shape having a bottom face that is situated to at bottom when the liquid container is attached to the liquid consuming apparatus, and a first side face that is substantially orthogonal to the bottom face, the liquid container comprising:

a first liquid storage chamber having a first upper face, a first bottom face, a first upstream opening, and a first downstream opening;

a second liquid storage chamber having a second bottom face, a second upstream opening, and a second downstream opening;

a connecting flow channel disposed between the first downstream opening and the second upstream opening so as to connect the first liquid storage chamber with the second liquid storage chamber;

a first partition wall defines the first bottom face and slopes so as to be lower towards a lowermost part of the first liquid storage chamber; and a second partition wall defines the first upper face and the second bottom face and slopes so as to be lower towards a lowermost part of the second liquid storage chamber, the lowermost part of the second liquid storage chamber being adjacent to the lowermost part of the first liquid storage chamber, the first upstream and downstream openings are adjacent to the first bottom face at the lowermost part of the first liquid storage chamber, and the second upstream and downstream openings are adjacent to the second bottom face at the lowermost part of the second liquid chamber.

2. The liquid container in accordance with claim 1, wherein the first downstream opening and the second upstream opening are closer together than the second downstream opening and the first upstream opening are.

3. The liquid container in accordance with claim 1, wherein the first downstream opening, the second upstream opening, and the connecting flow channel are formed along the first side face of the liquid container.

4. The liquid container in accordance with claims 1, further comprising:

an air chamber disposed between the first liquid storage chamber and an air introduction portion and adapted to trap liquid that attempts to backflow from the first liquid storage chamber towards the air introduction portion.

5. The liquid container in accordance with claim 4, wherein the air chamber having a second upper face defined by the first partition wall.

6. The liquid container in accordance with claim 1, wherein the second liquid storage chamber having a third bottom face defined by a third partition wall, the third partition wall inversely slopes with the second partition wall so as to be lower towards the lowermost part of the second liquid chamber, the first, second, and third partition walls extend radially and upwardly from one part of the bottom face of the liquid container.

7. The liquid container in accordance with claim 6, wherein the first downstream opening is the upstream terminus of the connecting passage, the second upstream opening is the downstream terminus of the connecting passage, and the first downstream opening and the second upstream opening are disposed closest to the one part.

8. The liquid container in accordance with claim 6, wherein an air chamber for trapping liquid that attempts to backflow from the first liquid storage chamber towards the air vent hole is disposed between the first liquid storage chamber and the air vent hole.

9. The liquid container in accordance with claim 8, wherein the air chamber having a second upper face defined by the first partition wall.

10. The liquid container in accordance with claim 6 including:

a pressure differential valve disposed between the second downstream opening and the liquid feed hole and adapted to regulate pressure of the liquid;

a bypass flow channel for bypassing the pressure differential valve during charging of liquid to the liquid storage chamber; and obstructing means for obstructing the bypass flow channel subsequent to charging with liquid.

* * * * *